US007582821B2

(12) United States Patent
Watanabe

(10) Patent No.: US 7,582,821 B2
(45) Date of Patent: Sep. 1, 2009

(54) ELECTRONIC MUSICAL INSTRUMENT KEYBOARD APPARATUS

(75) Inventor: Keisuke Watanabe, Hamamatsu (JP)

(73) Assignee: Yamaha Corporation, Hamamatsu-Shi (JP)

( * ) Notice: Subject to any disclaimer, the term of this patent is extended or adjusted under 35 U.S.C. 154(b) by 0 days.

(21) Appl. No.: 12/132,709

(22) Filed: Jun. 4, 2008

(65) Prior Publication Data

US 2008/0307944 A1 Dec. 18, 2008

(30) Foreign Application Priority Data

Jun. 7, 2007 (JP) ..... 2007-151098

(51) Int. Cl.
*G10C 3/12* (2006.01)

(52) U.S. Cl. ..... 84/423 R

(58) Field of Classification Search ..... 84/423 R, 84/430–436

See application file for complete search history.

(56) References Cited

U.S. PATENT DOCUMENTS 5,249,497 A * 10/1993 Niitsuma ..... 84/247
5,824,928 A * 10/1998 Kumano et al. ..... 84/423 R
5,880,389 A 3/1999 Muramatsu
6,005,178 A 12/1999 Osuga et al.
2003/0131711 A1 7/2003 Wenjun
2003/0183066 A1 10/2003 Gallitzendorfer
2005/0204906 A1 9/2005 Lengeling

FOREIGN PATENT DOCUMENTS

JP 6230770 8/1994

* cited by examiner

*Primary Examiner*—Kimberly R Lockett
(74) *Attorney, Agent, or Firm*—Morrison & Foerster LLP

(57) ABSTRACT

Key is pivotably supported by a key frame, and the front end of the key is normally urged upward by a pivot lever. Load member drivable by an actuator is provided rearwardly of a mass body of the pivot lever. Key switch and proximity sensor detect a pivoting position of the key responsive to depression and release operation of the key. Load control circuit performs driving control of the actuator, in accordance with the pivoting position of the key, to move the load member back and forth, to thereby cause the load member to engage (or contact) with the mass body in a depression stroke and terminates the engagement in a release stroke.

13 Claims, 6 Drawing Sheets

ELECTRONIC MUSICAL INSTRUMENT KEYBOARD APPARATUS

BACKGROUND

The present invention relates generally to keyboard apparatus for electronic musical instruments, such as electronic organs and electronic pianos.

With acoustic pianos, there is produced a key touch feeling called "let-off feeling" that, when a key has been depressed (i.e., static load has been applied to the key), the key touch temporarily becomes heavy (i.e., reactive force to the depressed key increases) partway through the key depression and then rapidly becomes light (i.e., the reactive force to the depressed key decreases) as the key is further depressed. Various schemes have been proposed to allow an electronic musical instrument keyboard apparatus to emulate such a let-off feeling. Japanese Patent No. 3458400, for example, discloses an electronic musical instrument keyboard apparatus, which includes hammers each not only pivoting in interlocked relation to movement of a corresponding key but also giving a feeling of mass during the key depression, and in which the rear end of the hammer contacts a roller that is supported by a resilient member. Immediately before the end of the key depression, the rear end of the hammer engages (or contacts) with the roller so that the reactive force to the depressed key increases by resistance of the resilient member. Upon end of the key depression, the rear end of the hammer disengages from the roller so that the reactive force to the depressed key rapidly decreases. In the aforementioned manner, a let-off feeling can be emulated.

In the aforementioned conventional keyboard apparatus, there can be achieved a left-off feeling, but, even at the time of key release, the reactive force to the depressed key would increase due to the engagement (or contact) between the hammer and the roller. Such increase of the reactive force at the time of the key release would retard a returning velocity of the key and thus adversely influence a successive key depression performance of the keyboard apparatus.

SUMMARY OF THE INVENTION

In view of the foregoing, it is an object of the present invention to provide an improved electronic musical instrument keyboard apparatus capable of achieving a let-off feeling while at the same time securing a good successive key depression performance.

In order to accomplish the above-mentioned object, the present invention provides an improved electronic musical instrument keyboard apparatus, which comprises: a depressable and releasable key; a key frame disposed beneath the key for supporting the key in such a manner that the key is pivotable with a front end of the key swinging vertically; a key urging mechanism assembled to the key frame for normally urging upwardly the front end of the key and limiting the front end to a predetermined height position; a movable (displaceable) member provided in the key urging mechanism and movable in interlocked relation to the key; a load member that imparts a load to pivoting movement of said key via the movable member; an actuator that drives the load member; a key position detection section that detects a pivoting position of the key responsive to depression and release operation of the key; and a load control section that performs driving control on the actuator in accordance with the pivoting position of the key detected by the key position detection section to impart a load to the pivoting movement of the key, in accordance with the detected pivoting position of the key, in such a manner that the load to be imparted by the load member in a depression stroke of the key is greater than the load to be imparted by the load member in a release stroke of the key.

In this case, the movable member may be in the form of a mass body having an elongated shape, movable in interlocked relation to the pivoting movement of the key and normally urging the front end of the key upwardly, and the load control section may cause the load member to engage (or contact) with the mass body in the depression stroke and terminates the engagement (or contact) of the load member with the mass body in the release stroke. Further, the actuator may be, for example, in the form of an electric actuator employing a super magnetostrictive device not only capable of providing a relatively great driving force with a low voltage but also having a quick response speed.

With the load control section performing driving control on the actuator, in accordance with the pivoting position of the key detected by the key position detection section, and changing the state of engagement of the load member with the movable member, in accordance with the detected pivoting position of the key, in such a manner that the load to be imparted in the depression stroke of the key is greater than the load to be imparted in the release stroke of the key, the present invention can increase a reactive force to depression of the key and decrease the reactive force during release of the key. As a result, the present invention can achieve not only a let-off feeling but also a good successive key depression performance.

The movable member and load member employed in the aforementioned invention may be replaced with a load member engageable with the key to impart a load to the pivoting movement of the key, and the load control section may perform driving control on the actuator in accordance with the pivoting position of the key detected by the key position detection section to change the state of engagement of the load member with the key, in accordance with the detected pivoting position of the key, in such a manner that the load to be imparted by the load member in the depression stroke of the key is greater than the load to be imparted by the load member in the release stroke of the key. In this case, the load control section may cause the load member to engage with the key in the depression stroke and terminate the engagement of the load member with the key in the release stroke. With such arrangements too, the present invention can increase the reactive force to depression of the key and decrease the reactive force during release of the key. As a result, the present invention can achieve not only a let-off feeling but also a good successive key depression performance.

The electronic musical instrument keyboard apparatus of the present invention may further comprise a depressing velocity detection section that detects a depressing velocity of the key, in which case the load control section may perform driving control on the actuator so that the force of the engagement of the load member or key with the movable member decreases as the detected depressing velocity increases. With such arrangements, the present invention can give a human player a massive key touch feeling in response to slow key depression and a light key touch feeling in response to rapid key depression. As a result, the key touch feeling can be even further improved.

The electronic musical instrument keyboard apparatus of the present invention may also be constructed so that the force of the engagement of the load member with the movable member or key decreases as the tone pitch corresponding to the key increases. In this case, the driving force to be applied to the actuator by the load control section may be set at different values in advance on a key-by-key or key-range-by-key-range basis, or the force of the engagement of the load member with the movable member or key may be set at different values in advance on the key-by-key or key-range-by-key-range basis. With such arrangements, the present invention can give the human player a massive key touch feeling in response to depression of a key in a low-pitch key range and a light key touch feeling in response to depression of a key in a high-pitch key range. As a result, the key touch feeling can be even further improved.

The following will describe embodiments of the present invention, but it should be appreciated that the present invention is not limited to the described embodiments and various modifications of the invention are possible without departing from the basic principles. The scope of the present invention is therefore to be determined solely by the appended claims.

BRIEF DESCRIPTION OF THE DRAWINGS

For better understanding of the objects and other features of the present invention, its preferred embodiments will be described hereinbelow in greater detail with reference to the accompanying drawings, in which.

DETAILED DESCRIPTION a. First Embodiment

Figure 1:
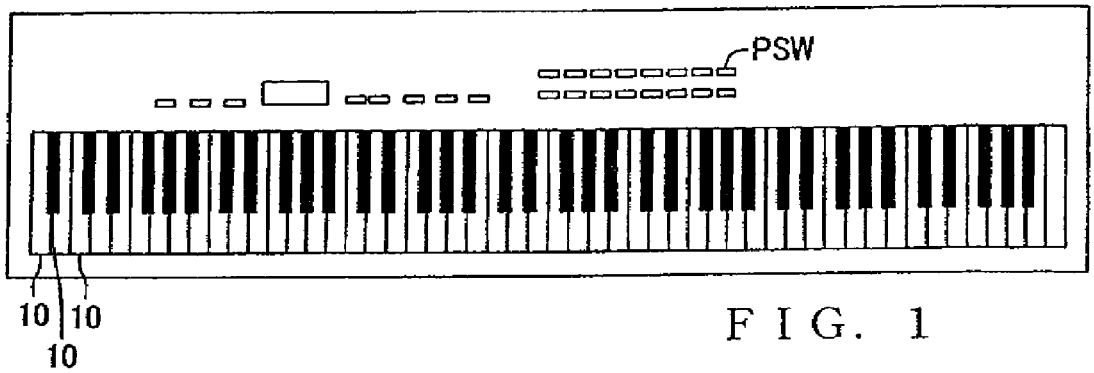
FIG. 1 is a plan view of an electronic musical instrument to which are applied keyboard apparatus according to first to third embodiments of the present invention.

FIG. 1 is a plan view showing an electronic musical instrument and a keyboard apparatus according to a first embodiment of the present invention employed in the electronic musical instrument. The electronic musical instrument includes a plurality of panel switchers PSW for selecting a desired operation style. The electronic musical instrument includes, on an upper front surface portion thereof, a keyboard apparatus having a plurality of white keys 10 and black keys 10 arranged in a horizontal left-right direction of the musical instrument.

Figure 2A:
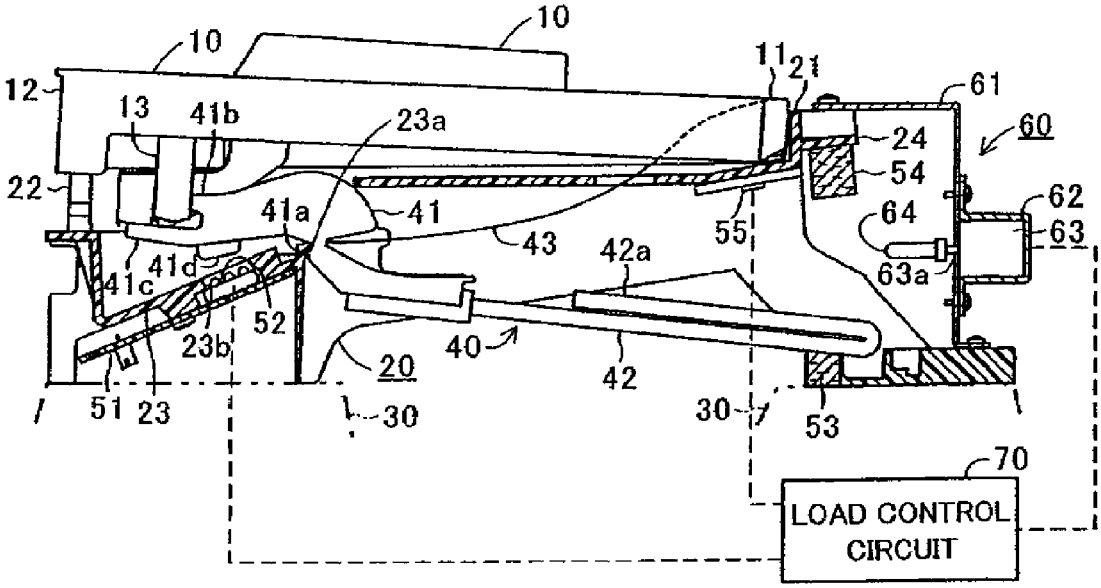
FIG. 2A is a vertical sectional view of the keyboard apparatus according to the first embodiment of the present invention, which shows a state where all keys are in a released position.
Figure 2B:
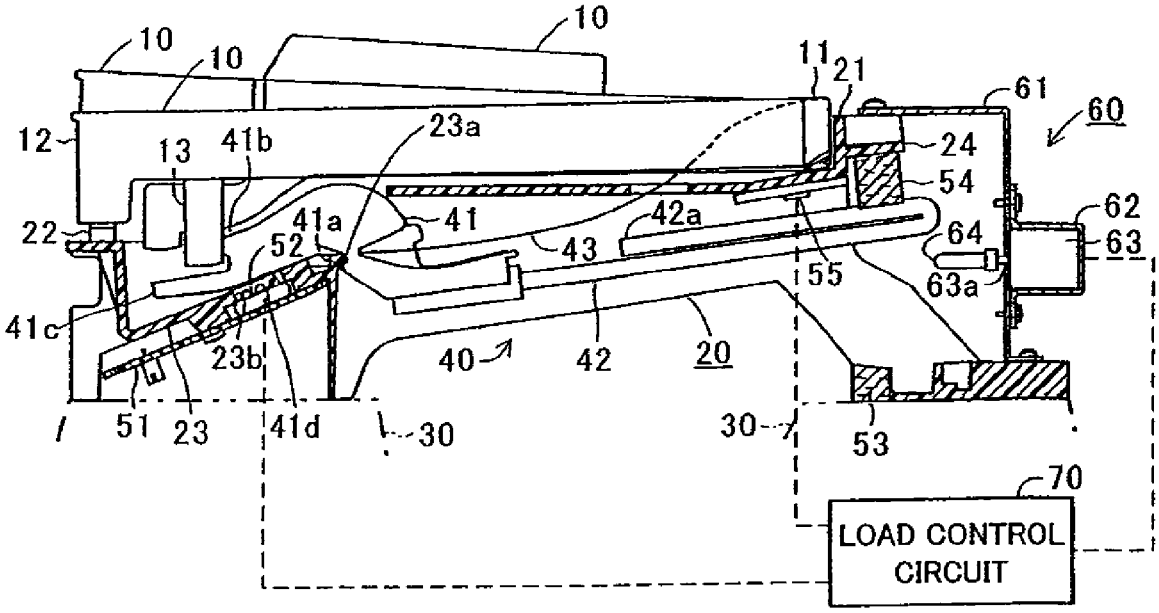
FIG. 2B is a vertical sectional view of the keyboard apparatus according to the first embodiment of the present invention, which shows a state where one of the keys is in a depressed position.

FIGS. 2A and 2B are vertical sectional views of the keyboard apparatus. More specifically, FIG. 2A shows a state where all of the keys 10 are in a released or non-depressed position, and FIG. 2B shows a state where one of the keys 10 is in a depressed position. The plurality of keys 10 are assembled to a key frame 20 formed integrally of synthetic resin, and the key frame 20 is fixed to and located over a support table 30. A plurality of pivot levels 40, constituting key biasing mechanisms corresponding to the keys 10, are assembled to the key frame 20 under the corresponding keys 10.

Each of the keys 10 is integrally formed of synthetic resin into a downwardly-opening U or channel sectional shape. Rear end portion 11 of each of the keys 10 is pivotably fitted in a forwardly-opening recess formed in a rear end portion 21 of the key frame 20. Each of the keys 10 is pivotably supported on the key frame 20 in such a manner that its front end portion 12 can vertically swing with side surfaces of the rear end portion 11 as a pivot point. Key guide 22 projecting upward from a front-end horizontal portion of the key frame 20 enters the front end portion 12 of the key 10 from below. During depression of the key, the front end portion 12 of the key 10 is displaced vertically while being guided by the key guide 22. Driving portion 13 is formed integrally with the underside of a front region near the front end portion 12 of the key 10 and extends vertically downward from the underside. The driving portion 13 has a U or channel horizontal sectional shape opening rearwardly and has a closed lower end.

The pivot lever 40 comprises a resin-made lever base section 41 and a metal-made mass body 42 as a movable or displaceable member. The lever base section 41, which is molded into an elongated and flat plate shape, extends in a front-rear-direction of the keyboard apparatus and is located under a front portion of the corresponding key 10 with its plate surface oriented generally vertically. The lever base section 41 has a recessed portion 41*a* formed in the lower surface of its longitudinally-middle region and having an axis line lying in the horizontal left-right direction (or key-arranged direction) of the keyboard, and the recessed portion 41*a* has a greater thickness in the axial direction. The recessed portion 41*a* opens obliquely forwardly and downwardly and engages with a pivot support portion 23*a* that is provided at the upper end of a slanting plate 23 extending obliquely rearwardly and upwardly from a front lower end position of the key frame 20. The pivot support portion 23*a* extends in the horizontal left-right direction (i.e., key-arranged direction) of the keyboard. The lever base section 41 is normally urged forward by a leaf spring 43 that constitutes a key urging mechanism supported on the rear end portion 11 of the key 10. In this manner, the pivot lever 40 is vertically pivotably supported on the key frame 20.

Front end portion of the lever base section 41 is vertically bifurcated into a pair of upper and lower leg portions 41*b* and 41*c* vertically spaced from each other by a predetermined space, and the upper leg portion 41*b* has a smaller length than the lower leg portion 41*c*. Lower end wall portion of the driving portion 13 of the key 10 is located between and engages with the upper and lower leg portions 41*b* and 41*c*. Thus, as the key 10 is released from the depressed position, a front end portion of the pivot lever 40 is displaced upward due to the weight of the lever 40, so that a front end portion of the key 10 too is displaced upward. On the other hand, as the key 10 is depressed, the lower end surface of the lower end wall portion of the driving portion 13 presses the upper surface of the lower leg portion 41*c*, so that the front end portion of the pivot lever 40 is displaced downward.

Downwardly-projecting switch driving portion 41*d* is formed on the underside of the lever base section 41 between the recessed portion 41*a* and the upper leg portion 41*b*. The switch driving portion 41*d* is opposed to a key switch 52 provided on a printed circuit board 52 via a window 23*b* formed through the slanting plate 23, and this key switch 52 constitutes a key position detection means. Such key switches 52 are provided in corresponding relation to the keys 10 and arranged in the horizontal left-right direction (i.e., key-arranged direction) of the keyboard.

Figure 3:
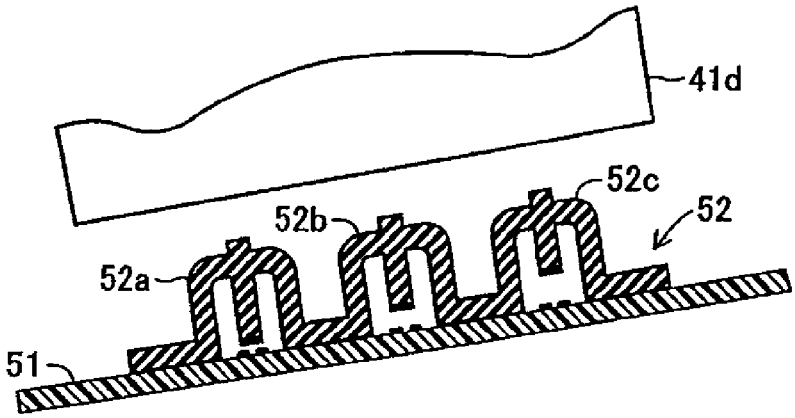
FIG. 3 is a detailed sectional view showing a construction of a key switch shown in FIGS. 2A and 2B.

As shown in enlarged scale in FIG. 3, each of the key switches 52 comprises first to third switches 52*a*, 52*b* and 52*c* arrayed in the front-rear direction of the keyboard. The first to third switches 52*a*, 52*b* and 52*c*, each of which is formed into a semispherical shape (or bowl shape) having an inner space, are provide on a switch member formed of a resilient substance, such as rubber or silicon, elongated in the left-right direction of the keyboard. Further, each of the first to third switches 52*a*, 52*b* and 52*c* has a cylindrical columnar portion formed integrally on, and extending downward from, a central inner surface portion thereof. Electric contact is provided on the lower end surface of the downwardly-projecting cylindrical columnar portion of each of the first to third switches 52*a*, 52*b* and 52*c*, and each of the electric contacts is opposed to two electric contacts provided on the printed circuit board 51 in corresponding relation to thereto. As the switch driving portion 41*d* moves downward in response to depression operation of the key 10, the first to third switches 52*a*, 52*b* and 52*c* are brought into contact with (or turn on) the corresponding electric contacts on the printed circuit board 51. Further, the cylindrical columnar portions of the first to third switches 52*a*, 52*b* and 52*c* have different lengths that become sequentially smaller in the order of mentioning. As the key 10 is depressed, the first, second and third switches 52*a*, 52*b* and 52*c* sequentially turn ON in the order of mentioning. As the key 10 is released, the third, second and first switches 52*c*, 52*b* and 52*a* turn OFF in the order of mentioning.

The mass body 42 of the pivot lever 40 is in the form of a rod, which is assembled integrally to the lever base section 41 by outsert-molding the lever base section 41 onto a front outer peripheral portion of the pivot lever 40. The mass body 42 has a rear folded-back portion 42*a*. The folded-back portion 42*a* differs in length among the mass bodies 42 corresponding to the plurality of keys 10, so that the mass bodies 42 differ in weight from one another. More specifically, for both the white keys 10 and the black keys 10, the folded-back portions 42*a* have lengths that gradually decrease, on a key-by-key or key-range-by-key-range basis, in a direction from the lowest-pitch key to the highest-pitch key, so that the mass bodies 42 for the keys of lower pitches or pitch ranges have greater weights, i.e. greater rotational moments. Further, for each pair of adjoining white and black keys 10, the length of the folded-back portion 42*a* of the black key 10 is set smaller than that of the white key 10 to avoid a difference that would occur in reactive force to key depression due to a difference in key depression position.

Further, an elongated lower limit stopper 53 made of an impact absorbing substance, such as felt, is secured to the upper surface of the support table 30 located on a rear end portion of the key frame 20, and the lower-limit stopper 53 extends in the horizontal left-right direction of the keyboard. The lower limit stopper 53 functions to limit downward displacement or movement of a rear end portion of the pivot lever 40, to thereby limit upward displacement of a front end portion of the key 10 when the key 10 is released from the depressed position. Further, an elongated upper limit stopper 54 made of an impact absorbing substance, such as felt, is secured to the lower surface of an upper surface plate 24 located on a rear end portion of the key frame 20. The upper limit stopper 54 is vertically spaced apart from the lower limit stopper 53 by a predetermined distance and extends in the left-right direction of the keyboard. The upper limit stopper 54 functions to limit upward displacement of the rear end portion of the pivot lever 40, to thereby limit downward displacement of the front end portion of the key 10 when the key 10 is depressed. The lower limit stopper 53 and upper limit stopper 54 both constitute the key urging mechanism. Proximity sensor (proximity switch) 55 is provided forwardly of the upper limit stopper 54 and in opposed relation to the mass body 42. The proximity sensor 55 is a sensor for detecting when the mass body 42 is in abutting contact with or located proximal to the upper limit stopper 54, using electromagnetic induction, electrostatic capacitance, ultrasonic sound wave, photo-electric effect, magnetic change, or the like. The proximity sensor 55 constitutes a key position detection means.

Driving unit 60 is assembled to the key frame 20 behind the keys 10. The driving unit 60 includes a support plate 61 bent into a generally hook-like shape and fixed to the key frame 20. Actuators 63, accommodated in a case 62 fixed to the support plate 61, are secured to the support plate 61 in corresponding relation to the keys 10. Driving rod 63*a* is normally urged leftward by a built-in spring. Each of the actuator 63, which is controlled electrically, displaces, by application of a voltage, the driving rod 63*a* in a rightward direction in the figure, to reciprocate a load member 64 fixed to the distal end of the driving rod 63*a*. The actuator 63 is preferably in the form of an electric actuator employing a super magnetostrictive device not only capable of providing a relatively great driving force with a low voltage but also having a quick response speed, although various other types of actuators, such as an electromagnetic solenoid, may be used as long as driving of the actuator can be electrically controlled. The load member 64 is molded of a resilient substance into a generally cylindrical columnar shape with a semispherical distal end. When the load member 64 is in a leftward projecting position as shown FIG. 2A, it engages (or contacts) with a rear end portion of the mass body 42, functioning as the movable or displaceable member, to impart a load to the pivoting movement of the mass body 42 and hence the key 10. This load can be adjusted by adjustment of any of the projecting amount, shape, substance, etc. of the load member 64.

The key switches 52 and proximity sensors 55 provided in corresponding relation to the keys 10 are connected to a load control circuit 70. The load control circuit 70 electrically controls the driving of each of the actuators 63 to cause the load member 64 to engage (or contact) with the mass body 42 as the displaceable member, to thereby impart a load to the pivoting movement of the key 10. The load control circuit 70 includes a microcomputer comprising a CPU, ROM, RAM, etc., and a drive circuit for outputting a driving signal to each of the actuators 63 in accordance with an instruction given by the microcomputer. More specifically, the load control circuit 70 is responsive to detection, by the proximity sensor 55, of proximity of the mass body 42 to output a driving voltage to the actuator 63 corresponding to the detected mass body 42 and then pull or retract the driving rod 63*a* in the rightward direction of the figure against the biasing force of the spring. Further, the load control circuit 70 detects a change from an ON state to an OFF state of the first switch 52*a*, in response to which it cancels or terminates the driving force to the actuator 63 corresponding to the detected first switch 52*a* to thereby cause the driving rod 63*a* to project in the leftward direction of the figure by the biasing force of the spring.

Signals from the first to third switches 52*a*-52*c* of each of the key switches 52 corresponding to the keys 10 are also supplied to a not-shown tone signal generation circuit. Upon detection of a change from the OFF state to the ON state of the third switch 52*c*, the tone signal generation circuit starts generating a tone signal of a tone pitch corresponding to the third switch 52*c* having changed to the ON state. Further, upon detection of a change from the ON state to the OFF state of the first switch 52*a*, the tone signal generation circuit starts attenuating the tone signal of the tone pitch corresponding to the first switch 52*a* having changed to the OFF state, and then ends the generation of the tone signal. Furthermore, the tone signal generation circuit inputs tone signals from the first and second switches 52*a* and 52*b* of each of the key switches 52 corresponding to the keys 10 and a key depressing velocity per key by measuring a length of time from a time point when the first switch 52*a* changes from the ON state to the OFF state to a time point when the second switch 52*b* changes from the OFF state to the ON state. The thus-detected key depressing velocity is used to control a tone volume and color of a tone signal to be generated.

Next, a description will be given about behavior of the keyboard apparatus constructed as above according to the first embodiment of the present invention. For each key 10 which is not being depressed (i.e., is in the non-depressed position), the rear end portion of the mass body 42 of the corresponding pivot lever 40 is in abutment against the lower limit stopper 53 by its own weight. Once the key 10 is depressed by a human player in this state, the key 10 starts pivoting in a counterclockwise direction of FIG. 2A about the rear end portion 11 against the weight of the mass body 42 of the pivot lever 40. Once the key 10 is depressed to a predetermined depth, the rear end portion of the mass body 42 abuts against the upper limit stopper 54 as shown in FIG. 2B, so that further downward displacement of the front end portion of the key 10 is prevented. At that time, as the pivot lever 40 pivots, the downwardly-extending switch driving portion 41*d* presses the key switch 52, so that the first, second and third switches 52*a*, 52*b* and 52*c* sequentially turn on the order of mentioning. Then, once the key 10 is released, the pivot lever 40 pivots in a clockwise direction of FIG. 2B about the pivot support portion 23*a* because of the weight of the mass body 42 of the pivot lever 40 until the rear end portion of the mass body 42 abuts against the lower limit stopper 53, so that the mass body 42 returns to its original position. The tone signal generation circuit controls the tone volume and color of a tone signal to be generated, in accordance with the detected key depressing velocity.

Figure 4A:
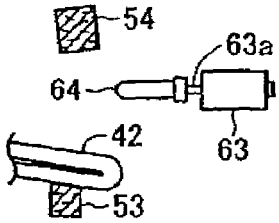
FIGS. 4A-4I are views showing positional relationship between a mass body of a pivot lever and a load member during depression/release operation of a key.
Figure 4B:
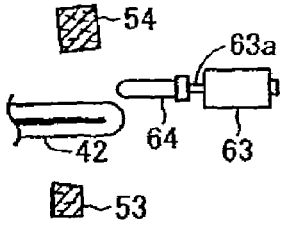
Figure 4C:
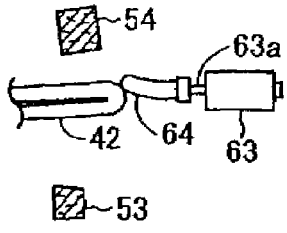
Figure 4D:
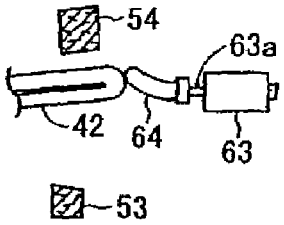
Figure 4E:
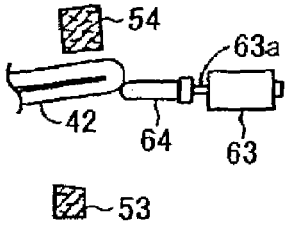

During such depression/release operation of the key 10, the load control circuit 70 performs control on the actuator 63 in accordance with the pivoting movement of the mass body 42, i.e. pivoting position of the key 10. When the first switch 52*a* of the key switch 52 is in the OFF state, the load control circuit 70 imparts no driving force to the actuator 63. In this state, the driving rod 63*a* of the actuator 63 is kept in the leftward projecting position as shown in FIG. 4A. As the key 10 and pivot lever 40 pivot in response to key depression operation so that the rear end portion of the mass body 42 is displaced upward as shown in FIGS. 4B and 4D, the rear end portion of the mass body 42 contacts a front end portion of the load member 64 to deform the load member 64. Then, as the rear end portion of the mass body 42 further moves upward, it gets over the front end portion of the load member 64 as shown in FIG. 4E. In this case, a force by the engagement (or contact) between the rear end portion of the mass body 42 and the load member 64, i.e. reactive force (resilient force) resultant from the deformation of the front end portion of the load member 64, acts as a load to the key depression operation by the human player. This load acts in such a manner that the key touch temporarily becomes heavy (i.e., reactive force to the depressed key increases). Then, as the key is further depressed, the engagement (or contact) between the rear end portion of the mass body 42 and the load member 64 is canceled and the load member 64 rapidly becomes light (i.e., the reactive force to the depressed key decreases), so that the human player can enjoy a let-off feeling.

As the key is depressed even further, the upper surface of the rear end portion of the mass body 42 abuts against the upper limit stopper 54, so that the pivot lever 40 stops pivoting. Immediately before the end of the pivoting movement of the pivot lever 40, the third switch 52*c* of the key switch 52 changes from the OFF state to the ON state, so that generation of the tone signal is started. The first and second switches 52*a* and 52*b* of the key switch 52 both change from the OFF state to the ON state by the time the rear end portion of the mass body 42 abuts against the load member 64.

Figure 4F:
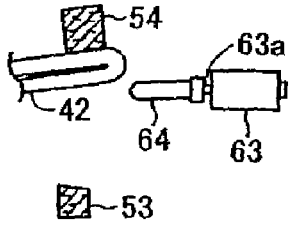
Figure 4G:
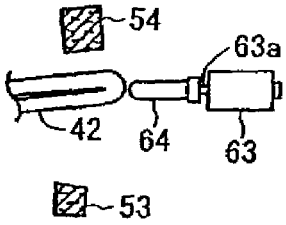
Figure 4H:
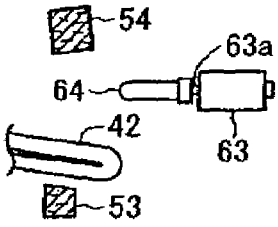

When the upper surface of the rear end portion of the mass body 42 has abutted against the upper limit stopper 54, the proximity sensor 55 detects proximity of the mass body 42, and the load control circuit 70 energizes and drives the actuator 63. Thus, the actuator 63 retracts the driving rod 63*a* in the rightward direction as shown in FIG. 4F against the biasing force of the spring. Then, once the depressed key 10 is released in the above-mentioned state, the rear end portion of the mass body 42 is displaced downward, as shown in FIG. 4F to FIGS. 4G and 4H, as the key 10 and pivot lever 40 pivot upward. Because the load member 64 has been retracted rightward, the rear end portion of the mass body 42 moves downward without contacting the front end portion of the load member 64. Then, the lower surface of the rear end portion of the mass body 42 abuts against the lower limit stopper 53, so that the key 10 and pivot lever 40 stop pivoting upward. In such a release stroke of the key 10, no load is imparted from the load member 64 to the pivoting movement of the key 10 and pivot lever 40 because the front end portion of the load member 64 does not engage (or contact) with the load member 64. Thus, a velocity at which the key 10 returns to the original position can be accelerated, with the result that operation for successively depressing the key 10 can be performed appropriately as desired; namely, successive depression performance of the key 10 can be effectively enhanced.

Figure 4I:
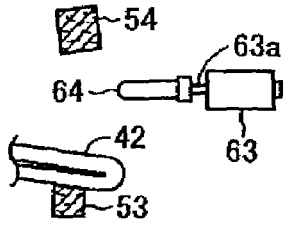

Immediately before the lower surface of the rear end portion of the mass body 42 abuts against the lower limit stopper 53 as noted above, the first switch 52*a* of the key switch 52 changes from the ON state to the OFF state. In response to the ON-to-OFF state change of the first switch 52*a*, the load control circuit 70 terminates the driving of the actuator 63. Thus, as shown in FIGS. 4I and 4A, the driving rod 63*a* of the actuator 63 again projects leftward by virtue of the biasing force of the spring. Then, the aforementioned behavior is repeated once the key 10 is again depressed and released by the human player.

If the same key 10 has been again depressed during the release stroke before the first switch 52*a* changes from the ON state to the OFF state, i.e. the same key 10 has been depressed successively more rapidly than in the aforementioned successive depression, the driving rod 63*a* is kept by the actuator 63 in the rightward-retracted position as shown in FIG. 4H. Thus, during the upward displacement of the mass body 42 caused by the key depression operation, the rear end portion of the mass body 42 moves downward without contacting the load member 64, and thus, no load is imparted from the load member 64 to the pivoting movement of the key 10 and pivot lever 40. Therefore, during the rapid successive depression operation of the key 10, the load member 64 does not engage (or contact) with the rear end portion of the mass body 42 in the key depression stroke too. Consequently, during the rapid successive depression operation of the key 10, the human player can perform depression and release operation of the key 10 as desired with no load applied from the load member 64 to the key 10, which can significantly facilitate a performance involving rapid successive depression operation of the key 10.

In the first embodiment, as set forth above, the driving rod 63*a* of the actuator 63 is normally urged by the spring in the leftward projecting position so that, in the release stroke of the key 10, the actuator 63 is driven to retract the driving rod 63*a* rightward against the biasing force of the spring. In a modification, however, the driving rod 63*a* of the actuator 63 may be normally urged by the spring to in a rightward projecting position so that, in the depression stroke of the key 10, the actuator 63 is driven to retract the driving rod 63*a* leftward to cause the rear end portion of the mass body 42 and the load member 64 to engage (or contact) with each other. In such a case, the load control circuit 70 drives the actuator 63 to cause the driving rod 63*a* to project leftward when the first switch 52*a* of the key switch 52 has changed from the OFF state to the ON state, taking electric power consumption into account. Then, once the rear end portion of the mass body 42 reaches the predetermined position proximal to the upper limit stopper 54, the load control circuit 70 terminates the driving of the actuator 63 so as to retract the driving rod 63*a* rightward by the biasing force of the spring.

In the aforementioned modification of the first embodiment too, a left-off feeling can be given, during the depression stroke of the key 10, to the key depression operation of the human player by the load member 64 engaging with the rear end portion of the mass body 42. Further, during the release stroke of the key 10, the load member 64 is disengaged from the rear end portion of the mass body 42 so that the returning velocity of the key 10 can be accelerated and thus a good successive depression performance can be maintained as desired. Furthermore, in this modification too, if the same key 10 has been again depressed before the first switch 52*a* changes from the ON state to the OFF state, i.e. the same key 10 has been depressed successively more rapidly than in the aforementioned successive depression, the driving rod 63*a* of the actuator 63 can continue to be is kept by the spring in the rightward retracted position. Namely, in this case, the load control circuit 70 does not detect a change from the OFF state to the ON state of the first switch 52*a* and does not drive the actuator 63. Thus, in this modification too, during the rapid successive depression operation of the key 10, the load member 64 does not engage (or contact) with the rear end portion of the mass body 42 in the key depression stroke too, and thus, a performance involving rapid successive depression operation of the key 10 can be executed with ease.

b. Second Embodiment

Figure 5:
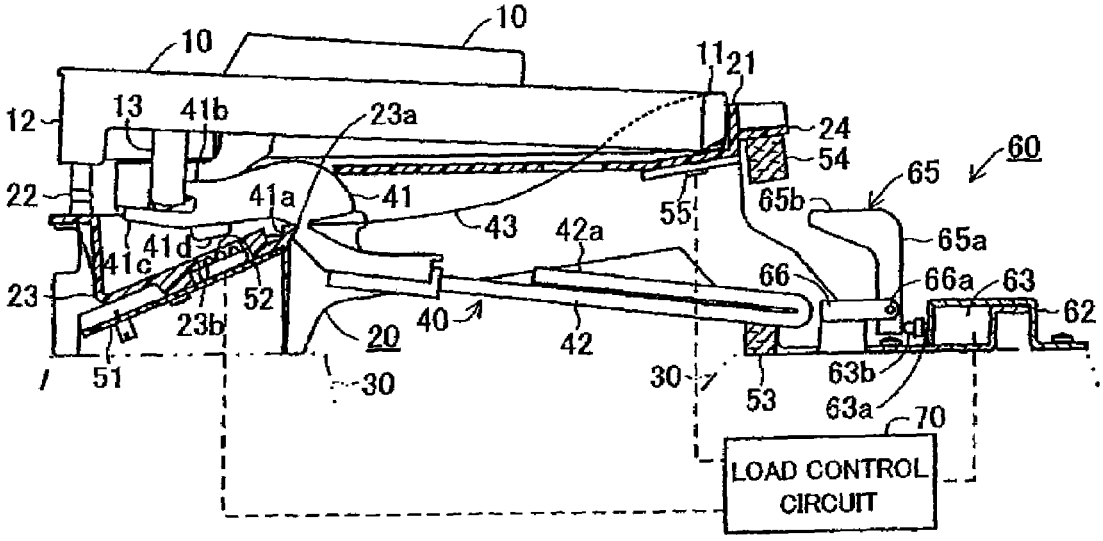
FIG. 5 is a vertical sectional view of the electronic musical instrument keyboard apparatus according to the second embodiment of the present invention, which shows a state where all of the keys are in a released position.

Next, a description will be given about the electronic musical instrument keyboard apparatus according to the second embodiment of the present invention, which employs a modified load mechanism for giving a load to the pivoting movement of the key 10 and pivot lever 40. FIG. 5 is a vertical sectional view of the electronic musical instrument keyboard apparatus according to the second embodiment of the present invention. This keyboard apparatus includes a load member 65 that is driven by the driving unit 60 to give a load to the pivoting movement of the key 10 and pivot lever 40. The load member 65 is formed integrally of synthetic resin into a hook-like or L shape having vertical and horizontal portions 65*a* and 65*b* extending substantially at right angles to each other. The load member 65 is rotatably supported at an intermediate region of the vertical portion 65*a* on a support section 66, fixed to the support table 30, via a pin 66*a*. The horizontal portion 65*b* of the load member 65 has a distant end portion projecting into an upper area where the front end portion of the mass member 42 passes. Only a front end portion of the horizontal portion 65*b* or the whole of the load member 65 may be formed of a resilient substance. The load member 65 is normally urged in a counterclockwise direction in the figure by a built-in weight or spring (not shown). Pressing member 63*b* fixed to the distal end of the driving rod 63*a* of the actuator 63 is held in abutment against the rear surface of a lower end portion of the vertical portion 65*a* of the load member 65. The pressing member 63*b* is formed of resin integrally with the driving rod 63*a* and has a distal end portion formed into a semispherical shape. The pressing member 63*b* may be formed of an elastic substance, such as rubber or elastomer, into a cylindrical columnar shape with a semispherical distal end.

The actuator 63 in the second embodiment is constructed similarly to the actuator 63 in the first embodiment, but, in the second embodiment, the driving rod 63*a* in this actuator 63 is normally urged by the built-in spring in a leftward retracted position. In this state, the rear end of the mass body 42 contacts (i.e., engages with) the front end of the horizontal portion 65*b* of the load member 65 as the mass body 42 is displaced between the lower limit stopper 53 and the upper limit stopper 54 by the pivoting movement of the key 10 and pivot lever 40. Once the actuator 63 is driven via the load control circuit 70, it causes the driving rod 63*a* to project in the leftward direction of the figure. Thus, the load member 65 pivots in the clockwise direction, so that the distal end portion of the horizontal portion 65*b* is displaced rearward. In this state, the rear end of the mass body 42 does not contact (i.e., does not engage with) the front end of the horizontal portion 65*b* of the load member 65 even if the mass body 42 is displaced between the lower limit stopper 53 and the upper limit stopper 54 by the pivoting movement of the key 10 and pivot lever 40. The actuator 63 is accommodated in the case 62 as in the above-described first embodiment, and the case 62 is fixed to the support table 30.

The load control circuit 70 starts driving the actuator 63 when the proximity sensor 55 has detected proximity of the mass body 42, and terminates the driving of the actuator 63 when the first switch 52*a* of the key switch 52 has changed from the ON state to the OFF state. The other structural arrangements of the second embodiment are similar to those of the first embodiment. Note that, in the second embodiment, the intensity of the load to the pivoting movement of the key 10 and pivot lever 40 is adjustable by adjusting any of the rotational amount, shape, substance, etc. of the load member 65.

Figure 6A:
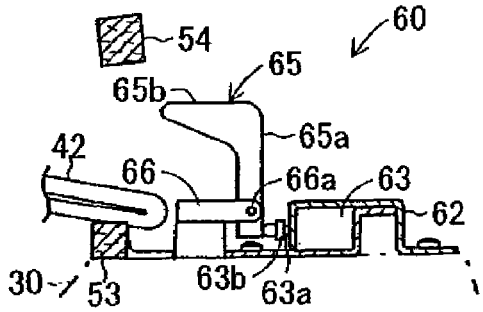
FIGS. 6A-6C are views showing positional relationship between the mass body of the pivot lever and the load member during depression/release operation of a key.
Figure 6B:
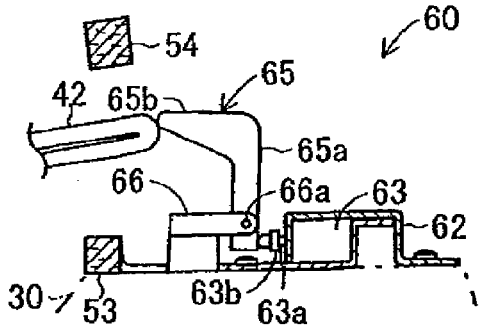

Next, a description will be given about behavior of the keyboard apparatus constructed as above according to the second embodiment of the present invention. Tone signal generation and termination of the tone signal generation responsive to depression/release operation of the key 10 is similar to that in the above-described first embodiment. In the second embodiment, during depression/release operation of the key 10, the load member 65 pivots about the pin 66*a* in response to the pivoting movement of the pivot lever 40 and driving of the actuator 63. When the key 10 is in the released position and the rear end portion of the mass body 42 is located over the lower limit stopper 53, the actuator 63 is in the non-driven state, so that the driving rod 53 is kept in the rightward retracted position, the pressing member 63*b* is kept in abutment against the rear surface of the lower end portion of the vertical portion 65*a* of the load member 65, and the front end of the horizontal portion 65*b* is kept in the forward (leftward in the figure) projecting position. When the key 10 is depressed in such a state, the rear end portion of the mass body 42 is displaced upward by the pivoting movement of the key 10 and pivot lever 40 as shown in FIG. 6B, so that the rear end portion of the mass body 42 engages (or contacts) with the front end portion of the horizontal portion 65*b* of the load member 65 and the load member 65 pivots in the clockwise direction against the biasing force of the weight or spring.

Figure 6C:
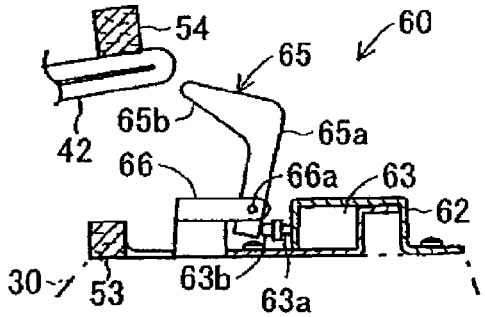

Then, as the rear end portion of the mass body 42 further moves upward, it gets over the front end portion of the horizontal portion 65*b* of the load member 65 and abuts against the upper limit stopper 54, as shown in FIG. 6C. Once the rear end portion of the mass body 42 gets over the front end portion of the horizontal portion 65*b* of the load member 65, the load member 65 returns to the original position (i.e., position shown in FIG. 6A) by virtue of the biasing force of the weight or spring. While the rear end portion of the mass body 42 is in engagement with the front end portion of the horizontal portion 65*b* of the load member 65, a force causing the load member 65 to pivot in the clockwise direction serves as a load to key depression operation of the human player during the depression stroke. Further, if the distal end of the horizontal portion 65*b* of the load member 65 or the whole of the load member 65 is formed of an elastic substance, a force caused by deformation of the elastic substance as well as the force causing the load member 65 to pivot in the clockwise direction serves as a load to key depression operation of the human player. Such a load acts in such a manner that the key touch temporarily becomes heavy (i.e., reactive force to the depressed key increases) partway through the key depression. Then, as the key is further depressed, the engagement between the rear end portion of the mass body 42 and the horizontal portion 65*b* of the load member 65 is canceled and the key touch rapidly becomes light (i.e., the reactive force to the depressed key rapidly decreases), so that the human player can enjoy a let-off feeling.

When the upper surface of the rear end portion of the mass body 42 has abutted against the upper limit stopper 54, the proximity sensor 55 detects proximity of the mass body 42, and the load control circuit 70 energizes and drives the actuator 63. The actuator 63 causes the driving rod 63*a* to project in the leftward direction as shown in FIG. 6C against the biasing force of the spring. Thus, the load member 65 pivots in the clockwise direction so that the front end of the horizontal portion 65*b* of the load member 65 moves rightward. Then, once the depressed key 10 is released in this state, the rear end portion of the mass body 42 is displaced downward as the key 10 and pivot lever 40 pivot upward. Because the front end of the horizontal portion 65*b* of the load member 65 has been retracted rightward, the rear end portion of the mass body 42 moves downward without contacting the front end portion of the load member's horizontal portion 65*b*. Then, the lower surface of the rear end portion of the mass body 42 abuts against the lower limit stopper 53, so that the key 10 and pivot lever 40 stop pivoting upward as shown in FIG. 6A. During the release stroke of the key 10, no load is imparted from the load member 65 to the pivoting movement of the key 10 and pivot lever 40 because the rear end portion of the mass body 42 does not engage (or contact) with the horizontal portion 65*b* of the load member 65. Thus, the velocity at which the key 10 returns to the original position can be accelerated, with the result that operation for successively depressing the key 10 can be performed more appropriately; namely, the successive depression performance of the key 10 can be effectively enhanced.

Immediately before the lower surface of the rear end portion of the mass body 42 abuts against the lower limit stopper 53 as noted above, the first switch 52*a* of the key switch 52 changes from the ON state to the OFF state. In response to the ON-to-OFF state change of the first switch 52*a*, the load control circuit 70 terminates the driving of the actuator 63. Thus, as shown in FIG. 6A, the driving rod 63*a* of the actuator 63 is again retracted rightward. Then, the aforementioned behavior is repeated once the key 10 is again depressed and released by the human player.

If the same key 10 has been again depressed before the first switch 52*a* changes from the ON state to the OFF state, i.e. the same key 10 has been depressed successively more rapidly than in the aforementioned successive depression, the driving rod 63*a* is kept by the actuator 63 in the leftward projecting position as shown in FIG. 6C. Thus, during the upward displacement of the rear end portion of the mass body 42 caused by the key depression operation, the rear end portion of the mass body 42 moves without contacting the horizontal portion 65*b* of the load member 65, and thus, no load is imparted from the load member 65 to the pivoting movement of the key 10 and pivot lever 40. Therefore, during the rapid successive depression operation of the key 10, the load member 65 does not engage (or contact) with the rear end portion of the mass body 42 in the key depression stroke too. Consequently, during the rapid successive depression operation of the key 10, the human player can perform depression and release operation of the key 10 with no load applied from the load member 65 to the key 10, which can facilitate a performance involving rapid successive depression operation of the key 10.

In the second embodiment, as set forth above, the driving rod 63*a* of the actuator 63 is normally urged by the spring in the rightward retracted position so that, in the release stroke of the key 10, the actuator 63 is driven to cause the driving rod 63*a* to project leftward against the biasing force of the spring. In a modification, however, the driving rod 63*a* of the actuator 63 may be normally urged by the spring in a leftward projecting position so that, in the depression stroke of the key 10, the actuator 63 is driven to retract the driving rod 63*a* rightward to cause the rear end portion of the mass body 42 and the horizontal portion 65*b* of the load member 65 to engage (or contact) with each other. In such a case, the load control circuit 70 drives the actuator 63 to cause the driving rod 63*a* to project rightward when the first switch 52*a* of the key switch 52 has changed from the OFF state to the ON state, taking electric power consumption into account. Then, once the rear end portion of the mass body 42 reaches the predetermined position proximal to the upper limit stopper 54, the load control circuit 70 terminates the driving of the actuator 63 so as to cause the driving rod 63*a* to project leftward by the biasing force of the spring.

In the aforementioned modification of the second embodiment too, a left-off feeling can be given, during the depression stroke of the key 10, to the key depression operation of the human player by the horizontal portion 65*b* of the load member 65 engaging with the rear end portion of the mass body 42. Further, during the release stroke of the key 10, the horizontal portion 65*b* of the load member 65 is disengaged from the rear end portion of the mass body 42 so that the returning velocity of the key 10 can be accelerated and thus a good successive depression performance can be maintained. Furthermore, in this modification too, if the same key 10 has been again depressed before the first switch 52*a* changes from the ON state to the OFF state, i.e. the same key 10 has been depressed successively more rapidly than in the aforementioned successive depression, the driving rod 63*a* of the actuator 63 can continue to be is kept by the spring in the leftward projecting position. Namely, in this case, the load control circuit 70 does not detect a change from the OFF state to the ON state of the first switch 52*a* and does not drive the actuator 63. Thus, in this modification too, during the rapid successive depression operation of the key 10, the horizontal portion 65*b* of the load member 65 does not engage (or contact) with the rear end portion of the mass body 42 during the key depression stroke too, and thus, a performance involving rapid successive depression operation of the key 10 can be executed with ease.

b. Third Embodiment

Figure 7:
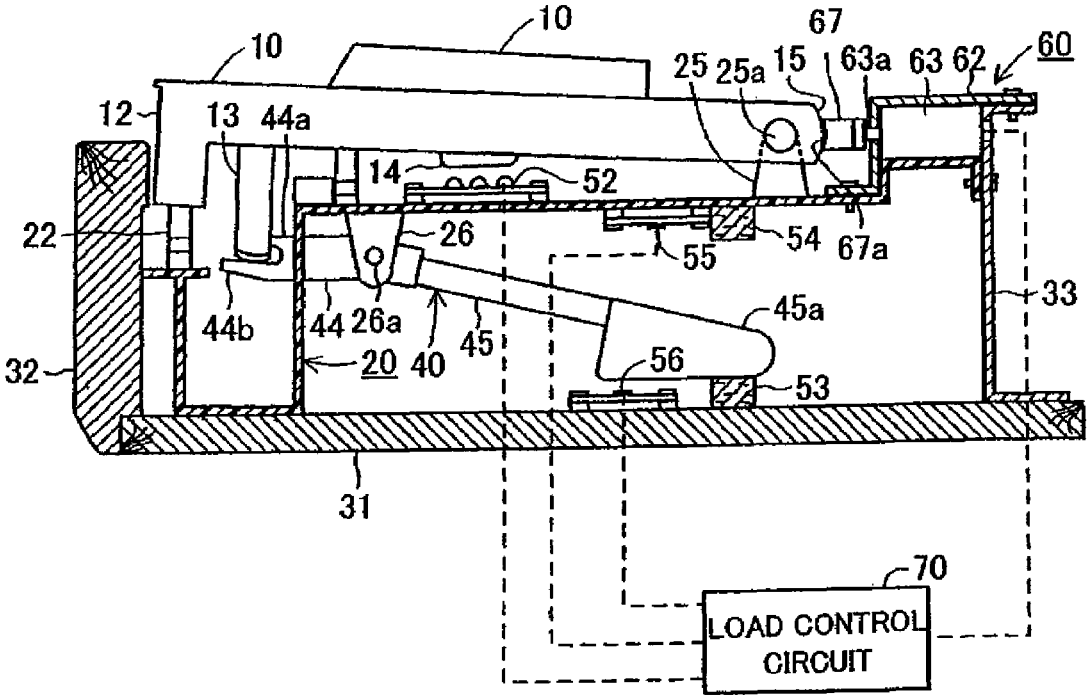
FIG. 7 is a vertical sectional view of the electronic musical instrument keyboard apparatus according to the third embodiment of the present invention, which shows a state where all of the keys are in a released position.

Next, a description will be given about the electronic musical instrument keyboard apparatus according to the third embodiment of the present invention, which is constructed to give a load to the pivoting movement of the key 10 and pivot lever 40. FIG. 7 is a vertical sectional view of the electronic musical instrument keyboard apparatus according to the third embodiment of the present invention. This keyboard apparatus includes, in place of the support table 30 employed in the first and second embodiments, a bottom plate 31 elongated in the left-right direction of the keyboard apparatus and formed by processing wood. Front plate 32 elongated in the left-right direction of the keyboard apparatus is fixed to the front longitudinal end edge of the bottom plate 31 and extends vertically upward from the front longitudinal end edge of the bottom plate 31, and a metal back surface panel 33 elongated in the left-right direction of the keyboard apparatus is fixed to the rear upper surface of the bottom plate 31 and extends vertically upward from the rear upper surface of the bottom plate 31. The key frame 20 in the third embodiment has a different shape from that employed in the first and second embodiments, and the key 10 is pivotably supported by the key frame 20 in a space surrounded by the bottom plate 31, front plate 32 and back surface panel 33.

Key support member 25 is fixed to the upper surface of a rear portion of the key frame 20, and this key support member 25 supports the key 10 in such a manner that the key 10 is pivotable about the axis of a pin 25*a* at a rear end portion of the key support member 25; the key support member 25 permits vertical pivoting movement of the key 10. The third embodiment of the keyboard apparatus, shaped differently from the above-described first and second embodiments, also includes the pivot lever 40 for normally urging the front end portion of the key 10 upward by the weight of the lever 40 and for limiting the front end portion of the key 10 to predetermined upper and lower positions. In this case too, the pivot lever 40 includes a lever base section 44 and mass body 45. The lever base section 44 is formed of synthetic resin and supported at a rear end portion on a lever support section 26 provided on the underside of the key frame 20 in such a manner that it is pivotable about the axis of a pin 26*a*. In this case too, the lever base section 44 has a pair of upper and lower leg portions 44*a* and 44*b* at its front end. The upper leg portion 44*a* has a smaller length than the lower leg portion 44*b*. Lower end wall portion of the driving portion 13 of the key 10 is located between and engages with the upper and lower leg portions 44*a* and 44*b*. Thus, as the key 10 is released from the depressed position, the front end portion of the pivot lever 40 is displaced upward due to the weight of the lever 40, so that the front end portion of the key 10 is displaced upward. As the key 10 is depressed, on the other hand, the lower end surface of the lower end wall portion of the driving portion 13 presses the upper surface of the leg portion 44*b*, and the front end portion of the pivot lever 40 is displaced downward.

The mass body 45 is in the form of a metal rod and fixed at its front end portion to the lever base section 44, and a resin-made stopper member 45*a* is integrally fixed to a rear end portion of the mass body 45. Similarly to the mass body 42 in the first and second embodiments, the mass body 45 urges the pivot lever 40 in the clockwise direction by its own weight. As the key 10 is released from the depressed position, the stopper member 45*a* abuts against the lower limit stopper 53 to limit clockwise pivoting movement of the pivot lever 40. As the key 10 is depressed, on the other hand, the stopper member 45*a* abuts against the upper limit stopper 54 to limit counterclockwise pivoting movement of the pivot lever 40. In the third embodiment too, the mass bodies 45 or stopper members 45*a* corresponding to the keys 10 have weights differing on the key-by-key or key-range-by-key-range basis so that the key depression touch becomes heavier for the keys 10 of lower pitches or lower pitch ranges.

Further, in the third embodiment, the key switch 52 is provided on the upper surface of a middle region, in the front-rear direction of the keyboard apparatus, of the key frame 20 and is depressed by a switch driving portion 14 provided on the underside of the key 10. The key switch 52 comprises first, second and third switches 52*a*, 52*b* and 52*c* as in the first and second embodiments. As the key 10 is depressed, the first, second and third switches 52*a*, 52*b* and 52*c* sequentially turn ON in the order of mentioning, while, as the key 10 is released, the third, second and first switches 52*c*, 52*b* and 52*a* turned OFF in the order of mentioning.

The driving unit 60 is provided in opposed relation to the rear end surface of the key 10. The driving unit 60 includes the actuators 63 accommodated in the case 62 fixed to the key frame 20 and back surface panel 33. Each of the actuator 63 is constructed similarly to that in the first and second embodiments, and the driving rod 63*a* retractably projects out of the case 62 toward the rear end surface of the key 10. In this case, the driving rod 63*a* is normally urged by the built-in spring in the leftward direction of the figure, and a load member 67 is held in a leftward projecting position when the actuator 63 is in the non-driven state. Once driven, the actuator 63 retracts the driving rod 63*a* rightwardly.

The load member 67 is fixed to the distal end of the driving rod 63*a*. The load member 67 is formed of an elastic substance, such as rubber or elastomer, and its front end surface 67*a* is recessed to have an arcuate sectional shape (as viewed transversely to the axis of the load member 67) and opposed to the rear end surface 15 of the key 10. The rear end surface 15 of the key 10 is formed convexly to have an arcuate sectional shape. When the actuator 63 is in the non-driven state, the front end surface 67*a* of the load member 67 is held in abutting engagement (or contact) with the rear end surface 15 of the key 10, and as the key 10 is depressed, the load member 67 gives a load to the pivoting movement of the key 10 and pivot lever 40 by a frictional force between the front end surface 67*a* and the rear end surface 15. When the actuator 63 is driven, the load member 67 is retracted rightward, so that the front end surface 67*a* of the load member 67 disengages from the rear end surface 15 of the key 10. The front end surface 67*a* of the load member 67 and the rear end surface 15 of the key 10 may be formed into a non-arcuate sectional shape, and the intensity of the load to be imparted to the pivoting movement of the key 10 and pivot lever 40 is adjustable by adjusting any of the driving force of the actuator 63, substance of the load member 67, shapes of the front end surface 67*a* of the load member 67 and the rear end surface 15 of the key 10, etc.

Further, the third embodiment of the keyboard apparatus includes, in addition to the proximity sensor 55 for detecting proximity of the mass body 45 during upward displacement of the mass body 45, a proximity sensor 56 fixed on the upper surface of the bottom plate 31 for detecting proximity of the mass body 45 during downward displacement of the mass body 45. The proximity sensor 56 is constructed similarly to the proximity sensor 55, and it detects proximity of the stopper member 45*a* (mass body 45) when or immediately before the stopper member 45*a* abuts against the lower limit stopper 53. Once the proximity sensor 55 detects proximity of the mass body 45 as the mass body 45 approaches the lower limit stopper 54, the load control circuit 70 drives the actuator 63 to retract the load member 67 in the rightward direction of FIG. 7. Further, once the proximity sensor 56 detects proximity of the mass body 45, i.e. shifts from the non-mass-body-proximity-detecting state to the mass-body-proximity-detecting state, the load control circuit 70 terminates the driving of the actuator 63 to thereby cause the load member 67 project in the leftward direction of FIG. 7.

Next, a description will be given about behavior of the keyboard apparatus constructed as above according to the third embodiment of the present invention. Tone signal generation and termination of the tone signal generation responsive to depression/release operation of the key 10 is similar to that in the above-described first and second embodiments. In the third embodiment, during depression/release operation of the key 10, the pivot lever 40 pivots to function as a reactive force to key depression. Further, in response to depression/release operation of the key 10, the load member 67 moves leftward and rightward in response to the driving of the actuator 63. When the key 10 is in the released position and the stopper member 45*a* of the mass body 45 is located over the lower limit stopper 53, the actuator 63 is in the non-driven state so that the driving rod 53 is kept in the leftward projecting position.

When the key 10 is depressed to pivot counterclockwise with the key's rear end moving downward in the aforementioned state, a load is imparted to the depression operation of the key 10 because the front end surface of the load member 67 is in engagement (or contact) with the rear end surface of the key 10. As the mass body 45 and stopper member 45*a* move upward, in response to the key depression operation, to approach the proximity sensor 55, the proximity sensor 55 detects proximity of the mass body 45 and stopper member 45*a*. In response to the detection by the proximity sensor 55, the load control circuit 70 retracts the actuator 63 in the rightward direction of the figure. Consequently, the load having been imparted by the load member 67 to the depressed key 10 is removed so that the key touch rapidly becomes light (i.e., the reactive force to the depressed rapidly key decreases), and thus, the human player can enjoy a let-off feeling. After that, the upward movement of the mass body 45 and stopper member 45*a* is terminated by the stopper member 45*a* abutting against the upper limit stopper 54.

Then, once the depressed key 10 is released, the mass body 45 and stopper member 45*a* are displaced downward as the key 10 and pivot lever 40 pivot. Because the front end surface 67*a* of the load member 67 is located out of contact with the rear end surface 15 of the key 10, the key 10 pivots in the clockwise direction without contacting the front end surface 67*a* of the load member 67, and the lower surface of the stopper member 45*a* of the mass body 45 abuts against the lower limit stopper 53, so that the key 10 and pivot lever 40 stop pivoting. Thus, the returning velocity of the key 10 can be accelerated, which allows the key 10 to be successively depressed appropriately as desired and thus achieve a good successive depression performance of the keyboard apparatus. Further, during the release stroke, the proximity sensor 56 detects proximity of the mass body 45 and stopper member 45*a* as the mass body 45 and stopper member 45*a* approach the sensor 56. In response to the detection by the proximity sensor 56, the load control circuit 70 terminates the driving of the actuator 63. Thus, the driving rod 63*a* of the actuator 63 is again pushed out leftward, so that the front end surface 67*a* of the load member 67 again engages (or contacts) with the rear end surface 15 of the key 10. Then, the aforementioned behavior is repeated once the key 10 is again depressed and released by the human player in such a state.

During the release stroke, on the other hand, the actuator 63 is kept in the driven state, the load member 67 is kept retracted in the rightward direction of the figure and the front end surface 67*a* of the load member 67 is kept out of engagement (or contact) with each other, before the proximity sensor 56 detects proximity of the mass body 45 and stopper member 45*a*. Thus, if the same key 10 has been again depressed before the proximity sensor 56 detects proximity of the mass body 45 and stopper member 45*a*, i.e. the same key 10 has been depressed successively more rapidly than in the aforementioned successive depression, the rear portion of the mass body 45 moves upward, in response to the key depression operation, without the front end surface 67*a* of the load member 67 engaging with the rear end surface 15 of the key 10. Thus, when rapid successive depression operation of the key 10 is to be performed, the human player can depress and release the key 10 with no load imparted from the load member 67 to the key 10. As a result, a performance involving rapid successive depression operation of the key 10 can be executed with ease.

In a modification of the above-described third embodiment, the driving, by the load control circuit 70, of the actuator 63 may be controlled using the key switch 52 in place of the proximity sensor 56. In this case, the load control circuit 70 may terminate the driving of the actuator 63 in response to a change from the ON state to the OFF state of the first switch 52*a* of the key switch 52. In this way, the modification can achieve the same advantageous results as the above-described third embodiment.

In the third embodiment, as set forth above, the driving rod 63*a* of the actuator 63 is normally urged by the spring to in the leftward projecting position so that, in the release stroke of the key 10, the actuator 63 is driven to retract the driving rod 63*a* rightward against the biasing force of the spring. In a modification, however, the driving rod 63*a* of the actuator 63 may be normally urged by the spring in the to rightward retracted position so that, in the depression stroke of the key 10, the actuator 63 is driven to cause the driving rod 63*a* to project leftward and thereby cause the front end surface 67*a* of the load member 67 to engage (or contact) with the rear end surface 15 of the key 10. In such a case, the load control circuit 70 drives the actuator 63 to cause the driving rod 63*a* to project leftward when the proximity sensor 56 shifts from the state where it is detecting proximity of the mass body 45 and stopper member 45*a* to the state where it is no more detecting proximity of the mass body 45 and stopper member 45*a*, taking electric power consumption into account. Then, once the rear end portion of the mass body 42 reaches the predetermined position proximal to the upper limit stopper 54, the load control circuit 70 terminates the driving of the actuator 63 so as to retract the driving rod 63*a* rightward by the biasing force of the spring.

In the aforementioned modification of the third embodiment too, a left-off feeling can be given, during the depression stroke of the key 10, to the key depression operation of the human player by the front end surface 67*a* of the load member 67 engaging with the rear end surface 15 of the key 10. Further, during the release stroke of the key 10, the front end surface 67*a* of the load member 67 disengages from the rear end surface 15 of the key 10, so that the returning velocity of the key 10 can be accelerated and thus a good successive depression performance can be maintained. Furthermore, in this modification too, if the same key 10 has been again depressed before the proximity sensor 56 detects proximity of the mass body 45 and stopper member 45*a*, i.e. the same key 10 has been depressed successively more rapidly than in the aforementioned successive depression, the driving rod 63*a* of the actuator 63 is kept by the spring in the rightward retracted position. Namely, in this case, the load control circuit 70 does not perform the driving control on the actuator 63 in response to a change from the proximity-detecting state to the non-proximity-detecting state of the proximity sensor 56. Thus, in this modification too, during the rapid successive depression operation of the key 10, the front end surface 67*a* of the load member 67 engaging with the rear end surface 15 of the key 10 does not engage (or contact) with the rear end surface 15 of the key 10, and thus, a performance involving rapid successive depression operation of the key 10 can be executed with ease.

In such a modification of the above-described third embodiment too, the termination of the driving, by the load control circuit 70, of the actuator 63 may be controlled using the key switch 52 in place of the proximity sensor 56. In this case, the load control circuit 70 may start the driving control of the actuator 63 in response to a change from the ON state to the OFF state of the first switch 52*a* of the key switch 52. In this way, the modification can achieve the same advantageous results as the above-described third embodiment.

In further modifications of the first and second embodiments, the driving control of the actuator 63 by the load control circuit 70 using the key switch 52 may be performed by the load control circuit 70 using the proximity sensor 56 of the third embodiment. In such a case, the proximity sensor 56 in the third embodiment is used to detect proximity, to the lower stopper 53, of the mass body 42. In the first and second embodiments and modifications thereof, the load control circuit 70 may replace the driving control of the actuator 63 responsive to a change from the OFF state to the ON state of the first switch 52*a* with the driving control of the actuator 63 responsive to a change from the mass-body-proximity detecting state to the non-mass-body-proximity detecting state of the proximity sensor 56. Alternatively, the load control circuit 70 may replace such driving control of the actuator 63 responsive to a change from the ON state to the OFF state of the first switch 52*a* with the driving control responsive to a change from the non-mass-body-proximity detecting state to the mass-body-proximity detecting state of the proximity sensor 56.

d. Fourth Embodiment

Next, a description will be given about an electronic musical instrument keyboard apparatus according to a fourth embodiment of the present invention. Briefly stated, the fourth embodiment is applicable to any one of the first, second and third embodiments and modifications thereof and arranged to perform control for changing a load to be imparted by the load member 64, 65 or 67 in accordance with a key depressing velocity and tone pitch. In this case, the manner in which the driving control of the actuator 63 is to be performed by the load control apparatus 70 differs among the first, second and third embodiments and modifications thereof. Only a portion of the driving control common to the first, second and third embodiments and modifications will first be explained first, and details of the application of the driving control, differing among to the first, second and third embodiments and modifications, will be later discussed.

Figure 8:
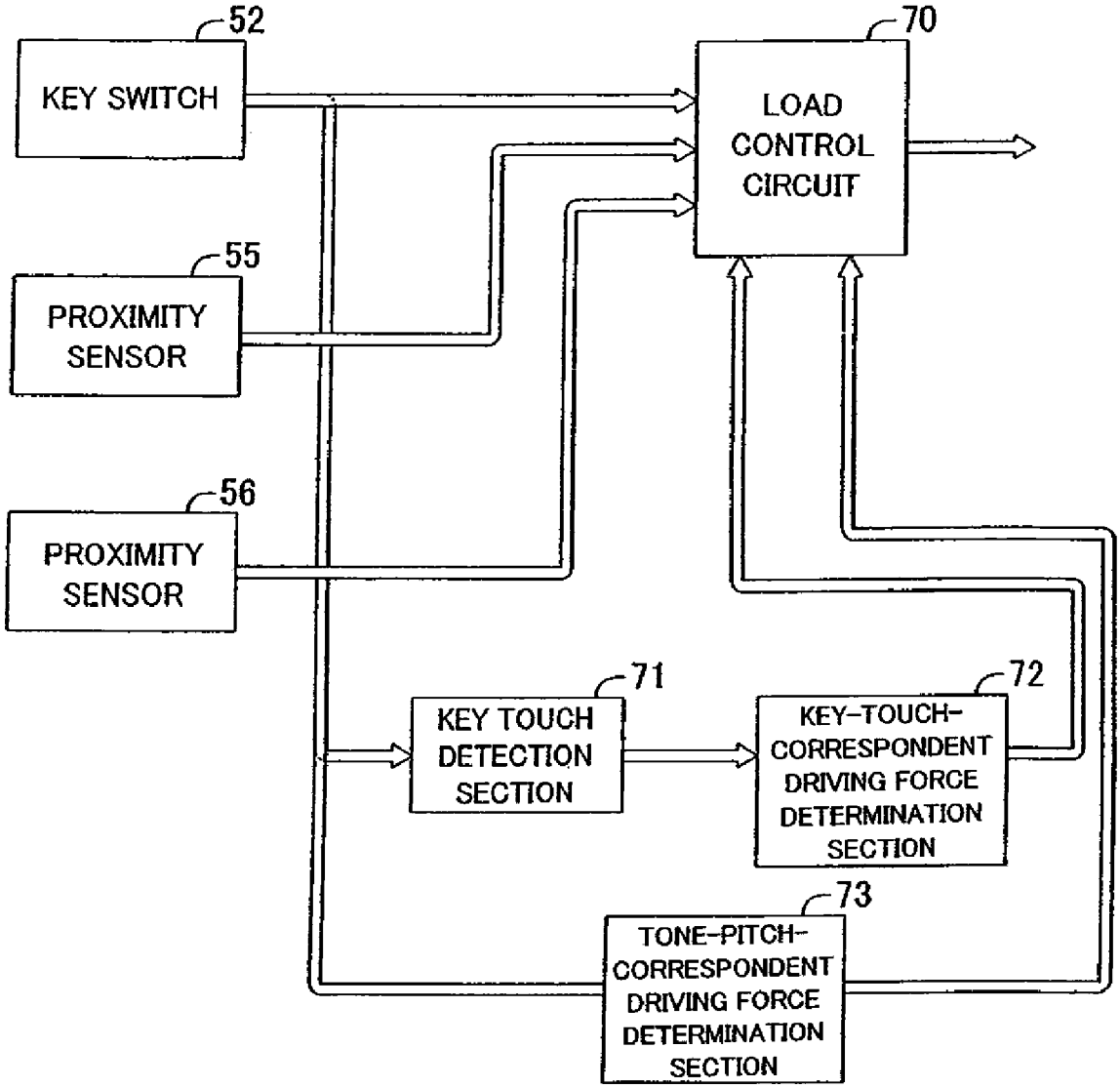
FIG. 8 is a block diagram of an electric control unit according to the fourth embodiment of the present invention.

FIG. 8 is a block diagram of an electric control unit which is common to (i.e., sharable among) the first, second, third embodiments and modifications thereof. To the load control circuit 70 are connected a key touch detection section 71, key-touch-correspondent driving force determination section 72 and tone-pitch-dependent driving force determination section 73. These key touch detection section 71, key-touch-correspondent driving force determination section 72 and tone-pitch-dependent driving force determination section 73 are implemented by a computer comprising a CPU, ROM, RAM, etc, and have the following functions performed through execution of software programs. The key touch detection section 71, detects depressing velocities of a plurality of keys 10, inputs signals from the first and second switches 52*a* and 52*b* of the key switches 52 corresponding to the keys 10. Then, the key touch detection section 71 measures a length of time from a time point when the first switch 52*a* has changed from the OFF state to the ON state to a time point when the second switch 52*b* changes from the OFF state to the ON state, to thereby detect a depressing velocity per key 10.

The key-touch-correspondent driving force determination section 72 refers to a key touch-driving force table stored in the ROM, to determine a driving force of the actuator 63 corresponding to the key depressing velocity detected by the key touch detection section 71. As indicated by a solid line A (or solid line B) in FIG. 9, the key touch-driving force table has stored therein driving forces that increase or decrease as the key depressing velocity increases. The key-touch-correspondent driving force determination section 72 outputs to the load control circuit 70 a signal indicative of a driving force that increase or decrease as the key depressing velocity increases or decreases. The tone-pitch-dependent driving force determination section 73 inputs signals from the first switches 52*a* of the key switches 52 corresponding to the keys 10 and refers to a tone pitch-driving force table stored in the ROM to determine a driving force of the actuator 63 in accordance with a tone pitch of the key 10 of which the first switch 52*a* has changed from the OFF state to the ON state. As indicated by a solid line A (or solid line B) in FIG. 10, the tone pitch-driving force table has stored therein driving forces that increase or decrease as the tone pitch increases or decreases. The tone-pitch-dependent driving force determination section 73 outputs to the load control circuit 70 a signal indicative of a driving force that increase or decrease as the tone pitch increases. The solid lines A and B of FIGS. 9 and 10 differ among the applications of the control according to the fourth embodiment to be explained below.

d1. Application to the First Embodiment:

In the first embodiment, the load member 64 is kept in the leftward projecting position by the biasing force of the spring while the actuator 63 is in the non-driven state, as shown in FIG. 2A. While the actuator 63 is driven, the load member 64 is kept in the rightward retracted position against the biasing force of the spring. Once the proximity sensor 55 detects proximity of the mass body 42, the load control circuit 70 drives the actuator 63 to retract the load member 64 rightward. Once the first switch 52*a* of the key switch 52 changes from the ON state to the OFF state, the load control circuit 70 terminates the driving of the actuator 63.

Figure 9:
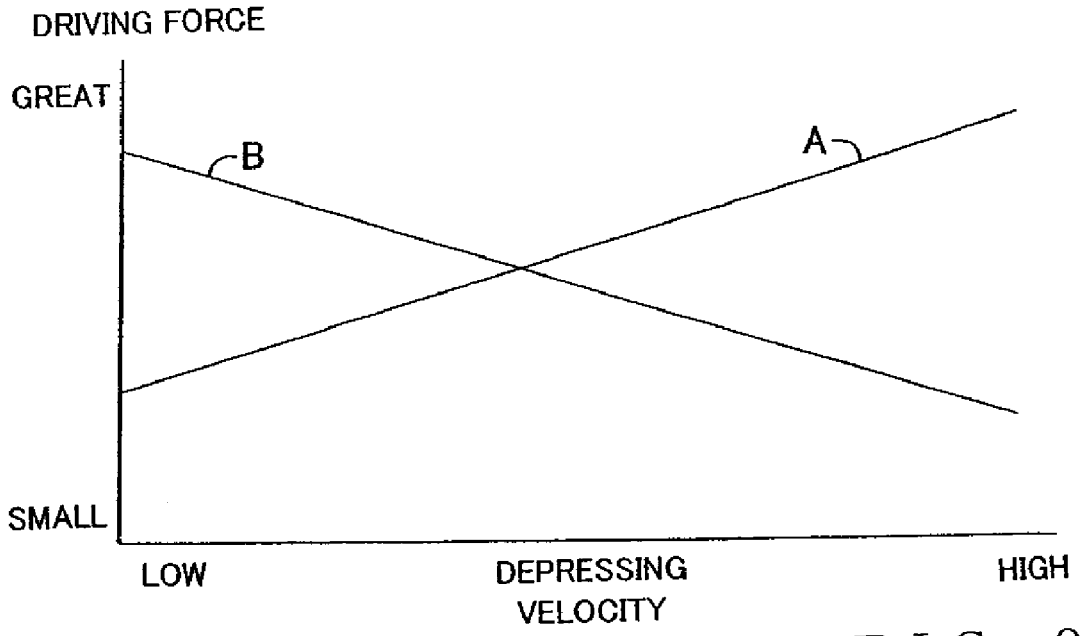
FIG. 9 is a graph showing variation characteristics of driving forces corresponding to various key depressing velocities.
Figure 10:
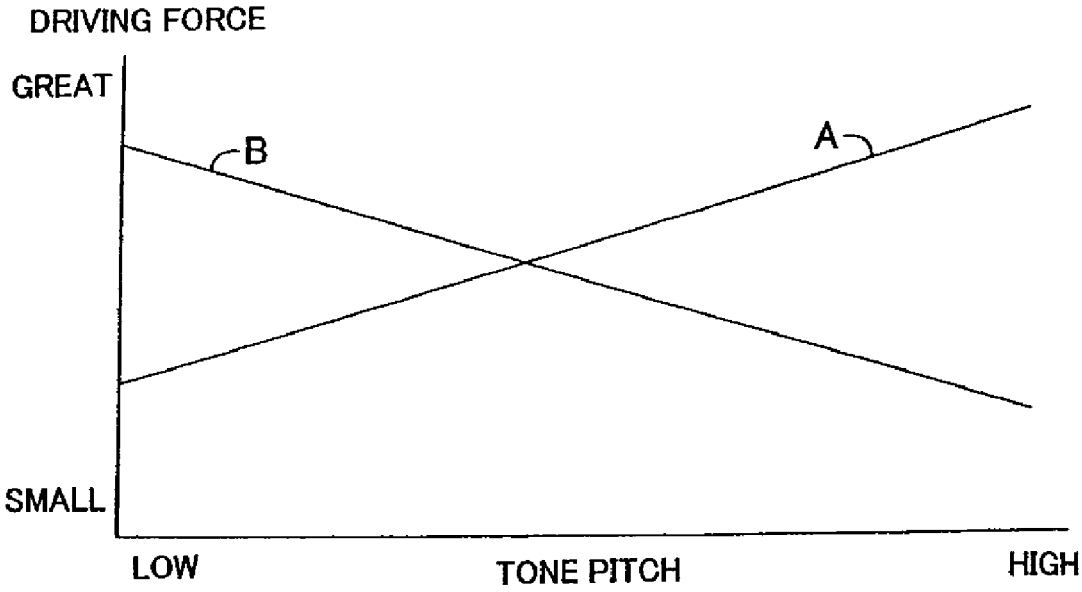
FIG. 10 is a graph showing variation characteristics of driving forces corresponding to various tone pitches.

In such an application to the first embodiment, the key-touch-correspondent driving force determination section 72 employs the characteristic indicated by the solid line A of FIG. 9 to determine a driving force that increases as the key depressing velocity increases, and the tone-pitch-dependent driving force determination section 73 employs the characteristic indicated by the solid line A of FIG. 10 to determine a driving force that increases as the tone pitch increases. Further, the load control circuit 70 adds together the thus-determined two driving forces and then drives the actuator immediately after the second switch 52*b* of the key switch 52 has changed from the OFF state to the ON state, i.e. upon detection of the key depressing velocity, so that the added driving force (i.e., driving force equal to the sum of the determined two driving forces) is produced. Note that the driving force thus generated by the actuator 63 is smaller than the driving force with which the load member 64 is retracted rightward by the actuator 63 being driven upon detection, by the proximity sensor 55, of proximity of the mass body 42. The driving of the actuator 63 responsive to the detection by the proximity sensor 55 and termination of the driving of the actuator 63 responsive to the change from the OFF state to the ON state of the first switch 52*a* is similar to that in the above-described first embodiment.

When the actuator 63 is driven with the smaller driving force, the load member 64 is retracted rightward because of balance between the biasing force of the built-in spring and the driving force, but the rear end portion of the mass body 42 engages (or contacts) with the load member 64 as the mass body 42 moves upward. Because the added driving force increases as the key depressing velocity and tone pitch increase, the rightward retracted amount of the load member 64 too increases as the key depressing velocity and tone pitch increase. Thus, the amount of the engagement between the rear end portion of the mass body 42 and the load member 64 during the upward movement of the mass body 42 decreases as the key depressing velocity and tone pitch increase. The load imparted from the load member 64 to the key 10 and pivot lever 40 in the key depression stroke decreases as the key depressing velocity and tone pitch increase. Consequently, with this application of the control to the first embodiment, it is possible to give the human player a massive key touch in response to slow key depression and a light key touch in response to rapid key depression. Further, it is possible to give the human player a massive key touch in response to depression of a key in a low pitch range and light key touch in response to depression of a key in a high pitch range. As a result, the key touch feeling can be even further improved.

d2. Application to the Modification of the First Embodiment

In the modification of the first embodiment, the load member 64 is kept in the rightward retracted position by the biasing force of the spring while the actuator 63 is in the non-driven state. While the actuator 63 is driven, the load member 64 is kept in the leftward projecting position against the biasing force of the spring. Once the first switch 52*a* of the key switch 52 changes from the OFF state to the ON state, the load control circuit 70 drives the actuator 63 to cause the driving rod 63*a* to project leftward. Further, once the rear end portion of the mass body 42 reaches the predetermined position proximal to the upper limit stopper 54, the load control circuit 70 terminates the driving of the actuator 63 so as to retract the driving rod 63*a* rightward by the biasing force of the spring.

In such an application of the control to the modification of the first embodiment, the key-touch-correspondent driving force determination section 72 employs the characteristic indicated by the solid line B of FIG. 9 to determine a driving force that decreases as the key depressing velocity increases, and the tone-pitch-dependent driving force determination section 73 employs the characteristic indicated by the solid line B of FIG. 10 to determine a driving force that decreases as the tone pitch increases. Further, the load control circuit 70 adds together the thus-determined two driving forces and then drives the actuator 63 immediately after the second switch 52*b* of the key switch 52 has changed from the OFF state to the ON state, i.e. upon detection of the key depressing velocity, so that the added driving force is produced. Then, the load member 64 projects leftward and stops at a position where the driving force of the actuator 63 and the biasing force of the built-in spring balance. Note that, at the time of the upward movement of the mass member 42, the position where the load member 64 stops is where the rear end portion of the mass body 42 and the load member 64 engage (or contact) with each other. The driving of the actuator 63 responsive to the change from the OFF state to the ON state of the first switch 52*a* may be or may not be omitted as necessary. The driving termination of the actuator 63 responsive to the detection by the proximity sensor 55 is similar to that in the above-described modification of the first embodiment.

Because the added driving force, equal to the sum of the driving forces determined in accordance with the key depressing key and tone pitch, decreases as the key depressing velocity and tone pitch increase, the leftward projecting amount of the load member 64 too decreases as the key depressing velocity and tone pitch increase. Thus, the amount of the engagement (or contact) between the rear end portion of the mass body 42 and the load member 64 during the upward movement of the mass body 42 decreases as the key depressing velocity and tone pitch increase. The load imparted from the load member 64 to the key 10 and pivot lever 40 during the key depression stroke decreases as the key depressing velocity and tone pitch increase. Consequently, with this application to the modification of the first embodiment too, it is possible to even further improve the key touch feeling.

d3. Application to the Second Embodiment

In the above-described second embodiment, the driving rod 63*a* is kept in the rightward retracted position and the load member 65 is normally urged in the counterclockwise direction by the biasing force of the spring while the actuator 63 is in the non-driven state, as shown in FIG. 6. When the actuator 63 is driven, the driving rod 63*a* projects leftward so that the load member 65 pivots in the clockwise direction against the biasing force of the spring or weight. Once the proximity sensor 55 detects proximity of the mass body 42, the load control circuit 70 drives the actuator 63 to cause the load member 64 to pivot in the clockwise direction rightward. Once the first switch 52*a* of the key switch 52 changes from the ON state to the OFF state, the load control circuit 70 terminates the driving of the actuator 63.

In such an application to the second embodiment, the key-touch-correspondent driving force determination section 72 employs the characteristic indicated by the solid line A of FIG. 9 to determine a driving force that increases as the key depressing velocity increases, and the tone-pitch-dependent driving force determination section 73 employs the characteristic indicated by the solid line A of FIG. 10 to determine a driving force that increases as the tone pitch increases. Further, the load control circuit 70 adds together the thus-determined two driving forces and then drives the actuator 63 immediately after the second switch 52*b* of the key switch 52 has changed from the OFF state to the ON state, i.e. upon detection of the key depressing velocity, so that the added driving force (i.e., driving force equal to the sum of the determined two driving forces) is produced. Note that the driving force thus generated by the actuator 63 is smaller than the driving force with which the load member 65 is caused to pivot clockwise by the actuator 63 being driven upon detection, by the proximity sensor 55, of proximity of the mass body 42. The driving of the actuator 63 responsive to the detection by the proximity sensor 55 and termination of the driving of the actuator 63 responsive to the change from the OFF state to the ON state of the first switch 52*a* is similar to that in the above-described second embodiment.

When the actuator 63 is driven with the smaller driving force, the load member 64 pivots clockwise by virtue of balance between the driving force and the biasing force of the built-in spring or weight, but the rear end portion of the mass body 42 engages (or contacts) with the load member 65 as the mass body 42 moves upward. Because the added driving force increases as the key depressing velocity and tone pitch increase, the amount of the clockwise pivoting movement of the load member 65 too increases as the key depressing velocity and tone pitch increase. Thus, the amount of the engagement (or contact) between the rear end portion of the mass body 42 and the load member 65 during the upward movement of the mass body 42 decreases as the key depressing velocity and tone pitch increase. The load imparted from the load member 65 to the key 10 and pivot lever 40 in the key depression stroke decreases as the key depressing velocity and tone pitch increase. Consequently, with this application to the second embodiment too, the key touch feeling can be even further improved.

d4. Application to the Modification of the Second Embodiment

In the above-described modification of the second embodiment, the driving rod 63*a* is kept in the leftward projecting position by the biasing force of the spring and the load member 65 is in the clockwise pivoting position against the biasing force of the spring or weight while the actuator 63 is in the non-driven state. When the actuator 63 is driven, the driving rod 63*a* is retracted rightward, and the load member 65 pivots counterclockwise by the biasing force of the spring or weight. Once the first switch 52*a* of the key switch 52 changes from the OFF state to the ON state, the load control circuit 70 drives the actuator 63 to retract the driving rod 63*a* rightward and thereby causes the load member 65 to pivot counterclockwise. Further, once the sensor 55 detects that the rear end portion of the mass body 42 has reached the predetermined position proximal to the upper limit stopper 54, the load control circuit 70 terminates the driving of the actuator 63 so as to cause the driving rod 63*a* to project leftward by the biasing force of the spring.

In such an application to the modification of the second embodiment, the key-touch-correspondent driving force determination section 72 employs the characteristic indicated by the solid line B of FIG. 9 to determine a driving force that decreases as the key depressing velocity increases, and the tone-pitch-dependent driving force determination section 73 employs the characteristic indicated by the solid line B of FIG. 10 to determine a driving force that decreases as the tone pitch increases. Further, the load control circuit 70 adds together the thus-determined two driving forces and then drives the actuator 63 immediately after the second switch 52*b* of the key switch 52 has changed from the OFF state to the ON state, i.e. upon detection of the key depressing velocity, so that the added driving force is produced. Then, the driving rod 63 is retracted rightward, and the load member 65 pivots counterclockwise and stops at a position where the driving force of the actuator 63 and the biasing force of the built-in spring balance. Note that, at the time of the upward movement of the mass member 42, the position where the load member 65 stops is where the rear end portion of the mass body 42 and the horizontal portion 65*b* of the load member 64 engage (or contact) with each other. The driving of the actuator 63 responsive to the change from the OFF state to the ON state of the first switch 52*a* may be or may not be omitted as necessary. The driving termination of the actuator 63 responsive to the detection by the proximity sensor 55 is similar to that in the above-described modification of the second embodiment.

Because the added driving force, equal to the sum of the driving forces determined in accordance with the key depressing key and tone pitch, decreases as the key depressing velocity and tone pitch increase, the amount of the pivoting movement in the counterclockwise direction of the load member 65 too decreases as the key depressing velocity and tone pitch increase. Thus, the amount of the engagement (or contact) between the rear end portion of the mass body 42 and the load member 64 during the upward movement of the mass body 42 decreases as the key depressing velocity and tone pitch increase. The load imparted from the load member 64 to the key 10 and pivot lever 40 during the key depression stroke decreases as the key depressing velocity and tone pitch increase. Consequently, with this application to the modification of the second embodiment too, it is possible to even further improve the key touch feeling.

d5. Application to the Third Embodiment

In the above-described third embodiment, the driving rod 63*a* is normally urged in the leftward direction by the biasing force of the spring and the load member 67 is kept in the leftward projecting position while the actuator 63 is in the non-driven state, as shown in FIG. 7. When the actuator 63 is driven, the driving rod 63*a* is retracted rightward so that the load member 67 moves rightward. Once the proximity sensor 55 detects proximity of the mass body 42, the load control circuit 70 drives the actuator 63 to retract the load member 67 rightward. Further, once the proximity sensor 56 changes from the non-mass-body-proximity detecting state to the mass-body-proximity detecting state, the load control circuit 70 terminates the driving of the actuator 63 to cause the load member 67 to project leftward.

In such an application to the third embodiment, the key-touch-correspondent driving force determination section 72 employs the characteristic indicated by the solid line A of FIG. 9 to determine a driving force that increases as the key depressing velocity increases, and the tone-pitch-dependent driving force determination section 73 employs the characteristic indicated by the solid line A of FIG. 10 to determine a driving force that increases as the tone pitch increases. Further, the load control circuit 70 adds together the thus-determined two driving forces and then drives the actuator 63 immediately after the second switch 52*b* of the key switch 52 has changed from the OFF state to the ON state, i.e. upon detection of the key depressing velocity, so that the added driving force (i.e., driving force equal to the sum of the determined two driving forces) is produced. Note that the driving force thus generated by the actuator 63 is smaller than the driving force with which the load member 67 is retracted rightward by the actuator 63 being driven upon detection, by the proximity sensor 55, of proximity of the mass body 42. The driving of the actuator 63 responsive to the detection by the proximity sensor 55 and termination of the driving of the actuator 63 responsive to the detection by the proximity sensor 56 is similar to that in the above-described third embodiment.

When the actuator 63 is driven with the smaller driving force, the front end surface 67*a* of the load member 67 engages (or contacts) with the rear end surface 15 of the mass body 42 as the mass body 42 moves upward. Because the added driving force increases as the key depressing velocity and tone pitch increase, the amount of the rightward retraction of the load member 67 too increases as the key depressing velocity and tone pitch increase. Thus, the amount of the engagement (or contact/friction) between the rear end portion of the mass body 42 and the horizontal portion of the load member 67 during the upward movement of the mass body 42 decreases as the key depressing velocity and tone pitch increase. The load imparted from the load member 67 to the key 10 and pivot lever 40 during the key depression stroke decreases as the key depressing velocity and tone pitch increase. Consequently, with this application to the third embodiment too, the key touch feeling can be even further improved.

d6. Application to the Modification of the Third Embodiment

In the above-described modification of the third embodiment, the driving rod 63*a* is normally urged in the rightward direction by the biasing force of the spring and the load member 67 is kept in the rightward retracted position while the actuator 63 is in the non-driven state. When the actuator 63 is driven, the driving rod 63*a* projects leftward so that the load member 67 moves leftward. Once the proximity sensor 56 changes from the state where it is detecting proximity of the mass body 45 and stopper member 45*a* to the state where it is no more detecting proximity of the mass body 45 and stopper member 45*a*, the load control circuit 70 drives the actuator 63 to cause the driving rod 63*a* to project leftward. Further, once the proximity sensor 55 detects that the rear end portion of the mass body 42 has reached the predetermined position proximal to the upper limit stopper 54, the load control circuit 70 terminates the driving of the actuator 63 so as to retract the driving rod 63*a* rightward by the biasing force of the spring.

In such an application to the modification of the third embodiment, the key-touch-correspondent driving force determination section 72 employs the characteristic indicated by the solid line B of FIG. 9 to determine a driving force that decreases as the key depressing velocity increases, and the tone-pitch-dependent driving force determination section 73 employs the characteristic indicated by the solid line B of FIG. 10 to determine a driving force that decreases as the tone pitch increases. Further, the load control circuit 70 adds together the thus-determined two driving forces and then drives the actuator 63 immediately after the second switch 52*b* of the key switch 52 has changed from the OFF state to the ON state, i.e. upon detection of the key depressing velocity, so that the added driving force is produced. Then, the driving rod 63 projects leftward and stops at a position where the driving force of the actuator 63 and the biasing force of the built-in spring balance. In this state, whereas the front end surface 67*a* of the load member 67 is abutting against the rear end surface 15 of the key 10, the abutting or pressing force of the front end surface 67*a* of the load member 67 is smaller than that in the above-described modification of the third embodiment. The driving of the actuator 63 responsive to the detection by the proximity sensor 56 may be or may not be omitted as necessary. The driving termination of the actuator 63 responsive to the detection by the proximity sensor 55 is similar to that in the above-described modification of the third embodiment.

Because the added driving force, equal to the sum of the driving forces determined in accordance with the key depressing key and tone pitch, decreases as the key depressing velocity and tone pitch increase, so that the amount of the counterclockwise direction of the load member 65 decreases as the key depressing velocity and tone pitch increase. Thus, the amount of the engagement (or contact/friction) of the front end surface 67*a* of the load member 67 with the rear end surface 15 of the key 10 in the key depression stroke decreases as the key depressing velocity and tone pitch increase. Thus, the load imparted from the load member 67 to the key 10 and pivot lever 40 in the key depression stroke decreases as the key depressing velocity and tone pitch increase. Consequently, with this application to the modification of the third embodiment too, it is possible to even further improve the key touch feeling.

d7. Modification of the Fourth Embodiment

In the above-described fourth embodiment, the load control circuit 70 is constructed to add together the driving forces determined by the key-touch-correspondent driving force determination section 72 and tone-pitch-dependent driving force determination section 73 and perform the driving control of the actuator 63 in accordance with a control signal indicative of the sum of the two driving forces. Alternatively, the load control circuit 70 may be constructed to multiply together the driving forces determined by the key-touch-correspondent driving force determination section 72 and tone-pitch-dependent driving force determination section 73 and perform the driving control of the actuator 63 in accordance with a control signal indicative of the product of the two driving forces. What matters here is to allow the driving forces, determined by the key-touch-correspondent driving force determination section 72 and tone-pitch-dependent driving force determination section 73, to be used in the driving control of the actuator 63.

Further, whereas the fourth embodiment has been described as constructed to vary the driving force continuously in accordance with variation in the key depressing velocity, the driving force may be varied in a stepwise fashion in accordance with variation in the key depressing velocity. Furthermore, the driving force may be varied in a stepwise fashion in accordance with variation in the tone pitch. Furthermore, relationship between the key depressing velocity and the driving force and relationship between the tone pitch and the driving force may be defined using respective predetermined functions.

Furthermore, in the driving force control responsive to the tone pitch, i.e. the control for imparting a load to the depressed key in accordance with the tone pitch, the load to be imparted to the depressed key may be changed through a given mechanical mechanism without the style of the driving control of the actuator 63 being changed in accordance with the tone pitch. Namely, in the above-described first embodiment, the load to be imparted to the depressed key by the load member 64 may be preset at different intensity values corresponding to various tone pitches by adjusting the projecting amount, shape, material, etc. of the load member 67 per key. In the above-described second embodiment, the load to be imparted to the depressed key by the load member 65 may be preset at different intensity values corresponding to various tone pitches by adjusting the pivoting amount, shape, material, etc. of the load member 66 per key. Further, in the above-described third embodiment, the load to be imparted to the depressed key by the load member 67 may be preset at different intensity values corresponding to various tone pitches by adjusting the shapes of the front end surface 67*a* and rear end surface 15 of the key 10, etc.

Furthermore, the fourth embodiment has been described above as applying, to the first embodiment, second embodiment and modifications thereof, the control responsive to the key depressing velocity and tone pitch, only in relation to control of the actuator 63 based on operation of the key switch 52 and detection by the proximity sensor 55. However, as set forth above in relation to the modification of the third embodiment, the control of the actuator 63 based on operation of the key switch 52 may be replaced with control based on detection by the proximity sensor 56. Further, the control responsive to the key depressing velocity and tone pitch to be performed on the third embodiment and modification thereof has been described above only in relation to control of the actuator 63 based on detection by the proximity sensors 55 and 56. Alternatively, as set forth above in relation to the modification of the third embodiment, the control of the actuator 63 based on detection by the proximity sensors 55 and 56 may be replaced with control based on operation of the key switch 52.

Furthermore, the fourth embodiment has been described above as varying the intensity of the load, which is to be imparted from the load member 64, 65 or 67 to a depressed key, in accordance with the key touch and tone pitch. Alternatively, the intensity of the load to be imparted from the load member 64, 65 or 67 to a depressed key may be controlled in accordance with only one of the key touch and tone pitch.

e. Other Modification

The present invention should not be construed as limited to the above-described embodiments, and various modifications of the invention are also possible without departing from the purposes and basic principles of the invention.

The first to fourth embodiments have been described above as constructed to detect a position of the mass body 42 or 45 by means of the proximity sensors 55 and 56. However, because the proximity sensors 55 and 56 detect pivoting positions of the key 10 and pivot lever 40, moving positions of other portions of the key 10 and pivot lever 40 may be detected. Further, the proximity sensors 55 and 56 may be replaced with contact switches, so as to detect contact with the contact switches in place of the proximity to the proximity sensors 55 and 56. Further, the first to the fourth embodiments have been described above as terminating the engagement (or contact) between the load member 64, 65 or 67 and the mass body 42 or 45 and key 10 during the key release stroke. Alternatively, the engagement (or contact) may be terminated in response to detection of a change from the ON state to the OFF state or from the OFF state to the ON state of the third switch 52*c* of the key switch 52.

Further, the first to fourth embodiments have been described above as causing the front end portion of the key 10 to swing vertically with the rear end portion as the pivot point. However, the pivot point of the key 10 may be other than the rear end portion of the key 10, such a middle portion of the key 10. In such a case, the key switch 52 for detecting depression and release of the key 10 may be provided on a rear portion of the key 10 so that the key switch 52 is activated in response to displacement of the rear end portion of the key 10. Further, the first to fourth embodiments have been described above as using the mass body 42 or 45 as a means for imparting a reactive force to key depression operation. Alternatively, in place of or in addition to the mass body 42 or 45, a spring may be employed, as the means for imparting a reactive force to key depression operation, to normally urge the key 10 upwardly.

Furthermore, the first to fourth embodiments have been described above as detecting a key depressing velocity on the basis of outputs from the first and second switches 52*a* and 52*b* of the key switch 52. However, the key depressing velocity may be detected in various other manners as along as a moving velocity of the key 10 or pivot lever 40 can be detected appropriately; for example, the moving velocity of the key 10 or pivot lever 40 may be detected electromagnetically by use of a coil or solenoid. In another alternative, the key depressing velocity may be detected by detecting a position of the key 10 or pivot lever 40 through electromagnetic induction, electrostatic capacitance, ultrasonic sound wave, photo-electric effect, magnetic change or the like and then differentiating the detected position.

Furthermore, the first and second embodiments have been described above as imparting a load to depression operation of the key 10 by engaging the load member 64 or 65 with the rear end portion of the mass body 42 of the pivot lever 40, and the third embodiment has been described above as imparting a load to depression operation of the key 10 by engaging the load member 67 with the rear end surface of the key 10. However, the present invention is not so limited, and the load member may be caused to engage (or contact) with any other suitable portion of the key 10 or pivot lever 40 as long as the load is imparted to the pivoting key 10 or pivot lever 40. For example, the load member may be caused to engage (or contact) with the front end portion 12 of the key 10, driving portion 13 of the key 10, or lever base section 41 or 44 of the pivot lever 40.

This application is based on, and claims priority to, JP PA 2007-151098 filed on 7 Jun. 2007. The disclosure of the priority applications, in its entirety, including the drawings, claims, and the specification thereof, is incorporated herein by reference.

What is claimed is:

1. An electronic musical instrument keyboard apparatus comprising:

a depressable and releasable key;

a key frame disposed beneath said key for supporting said key in such a manner that said key is pivotable with a front end of said key swinging vertically;

a key urging mechanism assembled to said key frame for normally urging upwardly the front end of said key and limiting the front end to a predetermined height position;

a movable member provided in said key urging mechanism and movable in interlocked relation to said key;

a load member that imparts a load to pivoting movement of said key via said movable member;

an actuator that drives said load member;

a key position detection section that detects a pivoting position of said key responsive to depression and release operation of said key; and a load control section that performs driving control on said actuator in accordance with the pivoting position of said key detected by said key position detection section to impart a load to the pivoting movement of said key, in accordance with the detected pivoting position of said key, in such a manner that a load to be imparted by said load member in a depression stroke of said key is greater than a load to be imparted by said load member in a release stroke of said key.

2. The electronic musical instrument keyboard apparatus as claimed in claim 1 wherein said load member is engageable with said movable member to impart the load to pivoting movement of said key.

3. The electronic musical instrument keyboard apparatus as claimed in claim 2 wherein said load control section performs the driving control on said actuator to change a state of engagement of said load member with said movable member, in accordance with the detected pivoting position of said key, so that the load to be imparted by said load member in the depression stroke of said key is greater than the load to be imparted by said load member in the release stroke of said key.

4. The electronic musical instrument keyboard apparatus as claimed in claim 2 wherein said movable member comprises a mass body having an elongated shape, movable in interlocked relation to the pivoting movement of said key and normally urging the front end of said key upwardly, and wherein said load control section causes said load member to engage with the mass body in the depression stroke and terminates the engagement of said load member with the mass body in the release stroke.

5. The electronic musical instrument keyboard apparatus as claimed in claim 2 which further comprises a depressing velocity detection section that detects a depressing velocity of said key, and wherein said load control section performs the driving control on said actuator so that a force of the engagement of said load member with said movable member decreases as the depressing velocity detected by said depressing velocity detection section increases.

6. The electronic musical instrument keyboard apparatus as claimed in claim 2 wherein a force of the engagement of said load member with said movable member decreases as a tone pitch corresponding to said key increases.

7. An electronic musical instrument keyboard apparatus comprising:

a depressable and releasable key;

a key frame disposed beneath said key for supporting said key in such a manner that said key is pivotable with a front end of said key swinging vertically;

a key urging mechanism assembled to said key frame for normally urging upwardly the front end of said key and limiting the front end to a predetermined height position;

a load member engageable with said key to impart a load to pivoting movement of said key;

an actuator that drives said load member;

a key position detection section that detects a pivoting position of said key responsive to depression and release operation of said key; and a load control section that performs driving control on said actuator in accordance with the pivoting position of said key detected by said key position detection section to impart a load to the pivoting movement of said key, in accordance with the detected pivoting position of said key, in such a manner that a load to be imparted by said load member in a depression stroke of said key is greater than a load to be imparted by said load member in a release stroke of said key.

8. The electronic musical instrument keyboard apparatus as claimed in claim 7 wherein said load control section performs the driving control on said actuator to change a state of engagement of said load member with said key, in accordance with the detected pivoting position of said key, so that the load to be imparted by said load member in the depression stroke of said key is greater than the load to be imparted by said load member in the release stroke of said key.

9. The electronic musical instrument keyboard apparatus as claimed in claim 7 wherein said load control section causes said load member to engage with said key in the depression stroke and terminates the engagement of said load member with the key in the release stroke.

10. The electronic musical instrument keyboard apparatus as claimed in claim 7 which further comprises a depressing velocity detection section that detects a depressing velocity of said key, and wherein said load control section performs the driving control on said actuator so that a force of the engagement of said load member with said key decreases as the depressing velocity detected by said depressing velocity detection section increases.

11. The electronic musical instrument keyboard apparatus as claimed in claim 7 wherein the force of engagement of said load member with said key decreases as a tone pitch corresponding to said key increases.

12. An electronic musical instrument keyboard apparatus comprising:

a depressable and releasable key;

a key frame disposed beneath said key for supporting said key in such a manner that said key is pivotable with a front end of said key swinging within a predetermined vertical range;

a key urging mechanism assembled to said key frame for normally urging upwardly the front end of said key;

a movable member provided in said key urging mechanism and movable in interlocked relation to said key;

a load member that imparts a load to pivoting movement of said key via said movable member;

an actuator that drives said load member;

a key position detection section that detects a pivoting position of said key responsive to depression and release operation of said key; and a load control section that performs driving control on said actuator in accordance with the pivoting position of said key detected by said key position detection section to impart a load to the pivoting movement of said key in a region of a predetermined pivotable range of said key.

13. An electronic musical instrument keyboard apparatus comprising:

a depressable and releasable key;

a key frame disposed beneath said key for supporting said key in such a manner that said key is pivotable with a front end of said key swinging vertically;

a key urging mechanism assembled to said key frame for normally urging upwardly the front end of said key;

a load member engageable with said key to impart a load to pivoting movement of said key;

an actuator that drives said load member;

a key position detection section that detects a pivoting position of said key responsive to depression and release operation of said key; and a load control section that performs driving control on said actuator in accordance with the pivoting position of said key detected by said key position detection section to impart a load to the pivoting movement of said key in a region of a predetermined pivotable range of said key.

* * * * *